US005438711A

United States Patent [19]

Higuchi et al.

[11] Patent Number: 5,438,711

[45] Date of Patent: Aug. 8, 1995

[54] APPARATUS FOR AUTOMATICALLY FEEDING SEAT COVERING PAPER TOILET SEAT

[75] Inventors: Mitsuhiro Higuchi; Shigeru Mizoguchi, both of Kitakyushu; Naoji Yamashita; Takayoshi Adachi, both of Kasugai, all of Japan

[73] Assignees: Toto Ltd., Fukuoka; Aicho Electric Co., Ltd., Aicho, both of Japan

[21] Appl. No.: 133,735

[22] Filed: Oct. 7, 1993

Related U.S. Application Data

[63] Continuation of Ser. No. 796,676, Nov. 25, 1991, abandoned.

[30] Foreign Application Priority Data

Nov. 26, 1990 [JP] Japan ..... 2-324946
May 30, 1991 [JP] Japan ..... 3-127910

[51] Int. Cl.[6] ..... A47K 13/20
[52] U.S. Cl. ..... 4/243.3; 4/243.1
[58] Field of Search ..... 4/243.2, 243.3, 243.1

[56] References Cited

U.S. PATENT DOCUMENTS

| | | | |
|---|---|---|---|
| 4,766,618 | 8/1988 | Boker | 4/243.2 |
| 4,921,211 | 5/1990 | Novak et al. | 4/623 X |
| 4,926,504 | 5/1990 | Higuchi et al. | 4/243.3 |
| 4,926,505 | 5/1990 | Higuchi et al. | 4/243.3 |
| 5,063,622 | 11/1991 | Tsutsui et al. | 4/623 |

*Primary Examiner*—Robert M. Fetsuga
*Attorney, Agent, or Firm*—Mark Catan; Thomas R. Morrison

[57] ABSTRACT

An electrically driven seat covering paper feeding mechanism feeds seat covering paper from a seat covering paper roll stored in a seat covering paper roll storage portion onto a toilet seat body through a seat covering paper feed path. A seat covering paper cutting mechanism cuts the seat covering paper fed to the surface of the toilet seat body at the rear edge portion of the paper. A control unit operates the electrically driven seat covering paper feeding mechanism by predetermined control signals sequentially output therefrom to control the feeding of the seat covering paper. A battery supplies electricity to the seat covering paper feeding mechanism and the control unit.

14 Claims, 24 Drawing Sheets

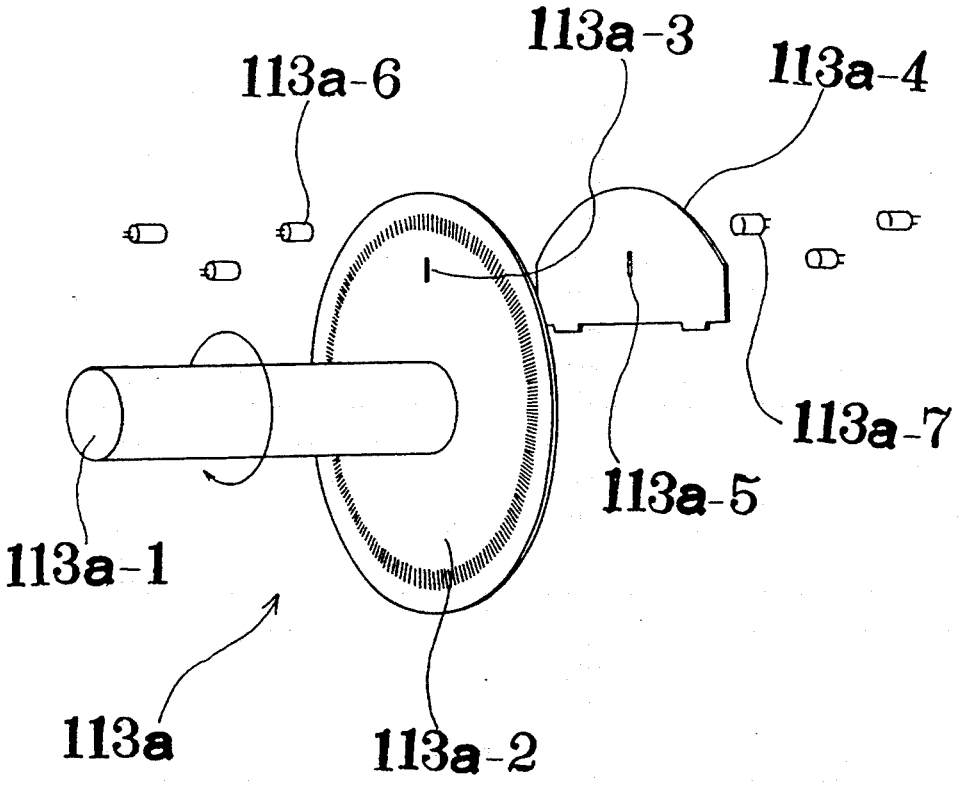
FIG. 22
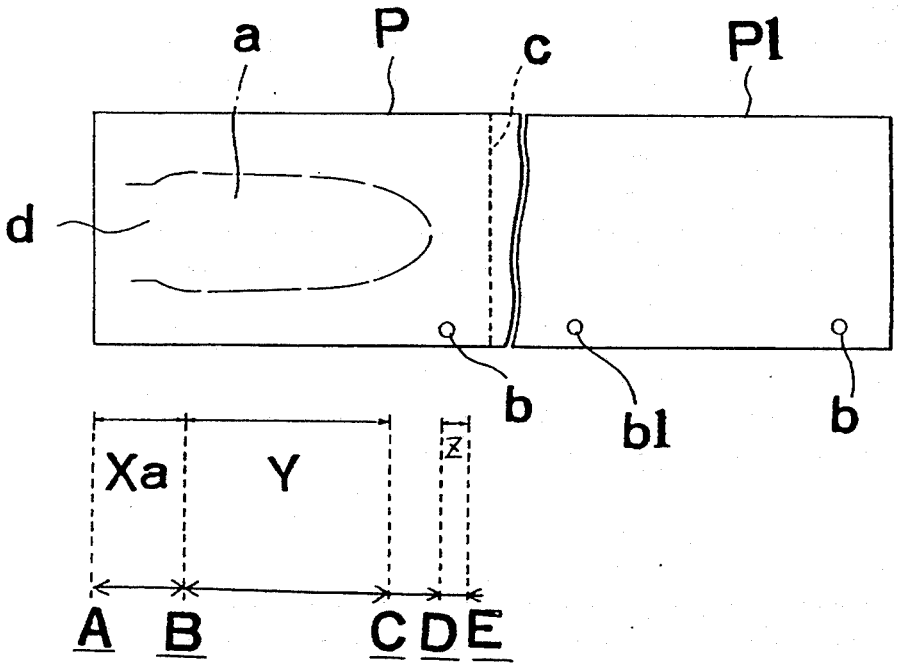

APPARATUS FOR AUTOMATICALLY FEEDING SEAT COVERING PAPER TOILET SEAT

This is a continuation of application Ser. No. 07/796,676 filed on Nov. 25, 1991, abandoned.

BACKGROUND OF THE INVENTION

The present invention relates to an apparatus for automatically feeding seat covering paper for a toilet seat.

Conventionally, an apparatus for automatically feeding seat covering paper for a toilet seat comprises, as disclosed in Japanese Patent Application No. 63-332274, a functional casing including a feed mechanism for feeding seat covering paper from a seat covering paper roll stored in a roll storage portion onto a toilet seat body through a feed path, a cutting mechanism for cutting the seat covering paper fed to the surface of the toilet seat body at the rear edge portion and clamping the rear edge portion of the paper, and a control unit for controlling operations of the feeding mechanism and cutting mechanism, the mechanisms and control unit being driven by a commercial power supply.

Since such an apparatus for automatically feeding seat covering paper for a toilet seat is driven by a commercial power supply, when the toilet seat with the automatic seat covering paper feeder is to be provided, for example, for a toilet in a public lavatory or a house where there is no facility for supplying power to the toilet equipment though there is a power supply for illumination, a power supply for the toilet equipment must be established. Therefore it is rather difficult to incorporate the automatic seat covering paper feeder into such a toilet. In restaurants, department stores, and other commercial buildings, a power supply cord hanging from the ceiling is unsightly and difficult to arrange.

OBJECTS AND SUMMARY OF THE INVENTION

It is an object of the present invention to provide a battery-driven apparatus for automatically feeding seat covering paper for a toilet seat that remedies the defects of a conventional apparatus.

It is another object of the present invention to provide a battery-driven apparatus for automatically feeding seat covering paper for a toilet seat wherein mechanisms such as the feeding mechanism and cutting mechanism are driven by a battery, thereby, making the apparatus useable in a place where it is difficult to arrange commercial power supply wiring and also to overcome the problem of unsightliness.

It is still another object of the present invention to provide a battery-driven apparatus for automatically feeding seat covering paper for a toilet seat wherein the apparatus is controlled by a control program in which, after a seat covering paper feeding switch is turned on or during the paper feeding operation the battery indicator comes on for a predetermined time to alert a user or a service man that the battery is low so that he can readily replace the battery with a new one to assure the normal operation of the apparatus.

It is a further object of the present invention to provide a battery-driven apparatus for automatically feeding seat covering paper for a toilet seat wherein the apparatus is provided with a control program in which the control unit determines the charge of the battery when the seat covering paper feeding switch is used several times after the above-mentioned alert of low battery. Thereafter, the battery indicator is continuously on to effectively avoid incomplete or erroneous operations of the mechanisms which are caused by shortages of battery power.

It is a still further object of the present invention to provide a battery-driven apparatus for automatically feeding seat covering paper for a toilet seat wherein the apparatus is provided with a control program in which a seat covering paper detecting sensor checks for perforations on the seat covering paper after the seat covering paper feeding switch is turned on and the seat covering paper is fed to a position where detecting perforations is possible so that the discharge of the battery due to the operation of the seat covering paper detecting sensor can be minimized.

It is a still further object of the present invention to provide a battery-driven apparatus for automatically feeding seat covering paper for a toilet seat wherein the apparatus is provided with a control program in which the control unit identifies the occurrence of clogging by absence of the seat covering paper within the functional casing in case the seat covering paper position detecting sensor does not detect the perforation within a predetermined time, makes the emergency signal generating means operate for a predetermined time, and makes the paper cutting mechanism return to and stop at the original or standby position. Even when the battery-driven apparatus is out of order due to any causes other than low battery power, the operation of the apparatus can be readily stopped thus preventing the unnecessary discharge of the battery. Furthermore, with this control program, since the paper cutting mechanism is to return to and stop at the original or standby position, as soon as the above problems are removed, the apparatus can readily resume the paper feeding operation.

It is a still further object of the present invention to provide a battery-driven apparatus for automatically feeding seat covering paper for a toilet seat wherein the apparatus is provided with a control program in which the control unit operates a plurality of electrically driven mechanisms by predetermined control signals sequentially output therefrom to control feeding of seat covering paper stored in the apparatus. The control unit also comprises a supply voltage detection portion for detecting the supply voltage to the control unit or a plurality of mechanisms, and changes the control signals supplied to the plurality of mechanisms in accordance with the results of detection by the supply voltage detection portion, whereby the most suitable control signal of the apparatus for automatically feeding the seat covering paper can be determined. Thus incomplete operation of a plurality of mechanisms resulting from a shortage of power and any trouble due to such incomplete operations, and, further, unstable control signals from the control unit can be reliably prevented.

It is a still further object of the present invention to provide a battery-driven apparatus for automatically feeding seat covering paper for a toilet seat wherein the apparatus is further provided with a seating detection means in the toilet seat and voltage is intermittently applied, at predetermined intervals, to the seating detection means from the time a user sits down on the toilet seat until the time the user stands up therefrom. The considerable consumption of electricity caused by its continuous supply to the seating detecting means from the time of sitting down on the seat to the time of leaving the seat can be avoided so that the effective operable voltage level of the battery can be prolonged.

It is a still further object of the present invention to provide a battery-driven apparatus for automatically feeding seat covering paper for a toilet seat wherein said apparatus is further provided with a paper position detection means for detecting presence or absence of seat covering paper fed onto said toilet seat body. A voltage is intermittently applied to said paper position detection means at predetermined intervals, so that the considerable consumption of electricity caused by its continuous supply to the paper position detecting means can be avoided and the effective operable voltage level of the battery can be prolonged.

It is a still further object of the present invention to provide a battery-driven apparatus for automatically feeding seat covering paper for a toilet seat, wherein the control unit controls the cutting mechanism so that, when the cutting mechanism is unable to cut the seat covering paper within a preset time, the cutting mechanism returns to a predetermined position. Accordingly, even when the torque of the motor is rapidly lowered by a sharp drop in battery voltage or the motor has to bear a torque that exceeds its rated torque, the consumption of the electricity caused by the continued actuation of the motor can be effectively prevented. Furthermore, since the cutting mechanism returns to the original position, the locking of the motor which leads to trouble can be minimized. Still further, since the cutting mechanism can be returned to the original position, at the time of repair or maintenance the apparatus can be readily dismantled and the seat covering paper can be readily replaced.

It is a still further object of the present invention to provide a battery-driven apparatus for automatically feeding seat covering paper for a toilet seat, wherein the apparatus is further provided with means for detecting the quantity of seat covering paper fed, and timer means for measuring the time of the feeding mechanism operates. The feeding mechanism, when the timer means counts for a preset period after the feeding mechanism has started up, is controlled in accordance with the detected value by the operating quantity detection means.

Where the seat covering paper cannot be fed normally for reasons such as the clogging of the paper, the decrease of battery voltage, or the malfunction of the motor, the motor cannot achieve the number of revolutions required for normal feeding within a preset time.

Accordingly, simultaneously with actuation of the feeding motor, the timer means counts the execution time when the revolutions of the motor detected by the revolution detecting means at the end of the preset time is lower than a predetermined level, it is determined that the feeding of the seat covering paper is abnormal.

Thereafter, the feeding motor is readily stopped so that any troubles such as a motor overload, the paper clogging, or the worsening of any other problem can be avoided.

It is a still further object of the present invention to provide a battery-driven apparatus for automatically feeding seat covering paper for a toilet seat, wherein a rotary encoder is employed as the revolution detection means for the paper feeding motor so that the revolutions of the feeding motor can be accurately detected, thereby accurately and promptly detecting any paper clogging. The construction of the revolution detecting means can be simplified as well. Furthermore, the rotary encoder consumes the least electricity in its operation, so its use prolongs the life of the battery. Still further, even if the battery voltage is low, the rotary encoder can accurately detect the revolution of the feeding motor and thereby the clogging of the paper during paper feeding even with a lower voltage level of the battery.

A HOLL IC element as the revolution detecting means may be substituted for the rotary encoder, wherein the HOLL IC element makes use of the change of the magnetic field caused by the rotation of the motor. However, the HOLL IC element consumes a considerable amount of electricity and cannot accurately detect the revolution of the motor when the voltage is too low. Accordingly, the rotary encoder is preferable to the HOLL IC element.

In summary, this invention discloses an apparatus for automatically feeding seat covering paper for a toilet seat comprising: (a) an electrically driven seat covering paper feeding mechanism for feeding the seat covering paper from a seat covering paper roll stored in a seat covering paper roll storage portion onto a toilet seat body through a seat covering paper feed path, and the seat covering paper feeding mechanism includes a seat covering paper feeding motor; (b) and electrically driven seat covering paper cutting mechanism for cutting the seat covering paper fed to the surface of the toilet seat body at a rear edge portion of the seat covering paper; (c) timer means for measuring the operating time of the paper feeding motor; (d) revolution detecting means for detecting the total number of revolutions of the paper feeding motor; (e) a control unit for operating the electrically driven seat covering paper feeding mechanism and the electrically driven seat covering paper cutting mechanism by predetermined control signals sequentially output therefrom to thereby control feeding of the seat covering paper to be fed on the toilet seat body and cutting of the seat covering paper, the control unit having a program in which i) upon detection of the total number of revolutions of the paper feeding motor by the revolution detecting means after a predetermined paper feeding time set by the timer means from the start of the feeding of the seat covering paper, even when the detected total revolutions of the paper feeding motor does not reach a predetermined total revolutions which corresponds to a distance necessary for feeding the seat covering paper onto the toilet seat body, so long as the detected total revolutions yet exceed a predetermined threshold total revolutions level, the operation of the feeding motor is maintained for the suitable length of time in addition to a predetermined paper feeding time, and ii) if the total revolution of the paper feeding motor detected by the revolution detecting means does not exceed the predetermined threshold total revolutions level, the operation of the feeding motor is readily stopped as soon as the predetermined paper feeding time is over; and (f) battery means for supplying electricity to the seat covering paper feeding mechanism, the seat covering paper cutting mechanism, the control unit, the timer means, and the revolution detecting means.

BRIEF DESCRIPTION OF THE DRAWINGS

FIG. 9A(*b*) is another partial plan view of the battery case.

FIG. 21A is a perspective view of the rotary encoder which works as the operation amount detection means.

FIG. 22 is a plan view of seat covering paper.

DETAILED DESCRIPTION OF THE PREFERRED EMBODIMENT

Figure 1:
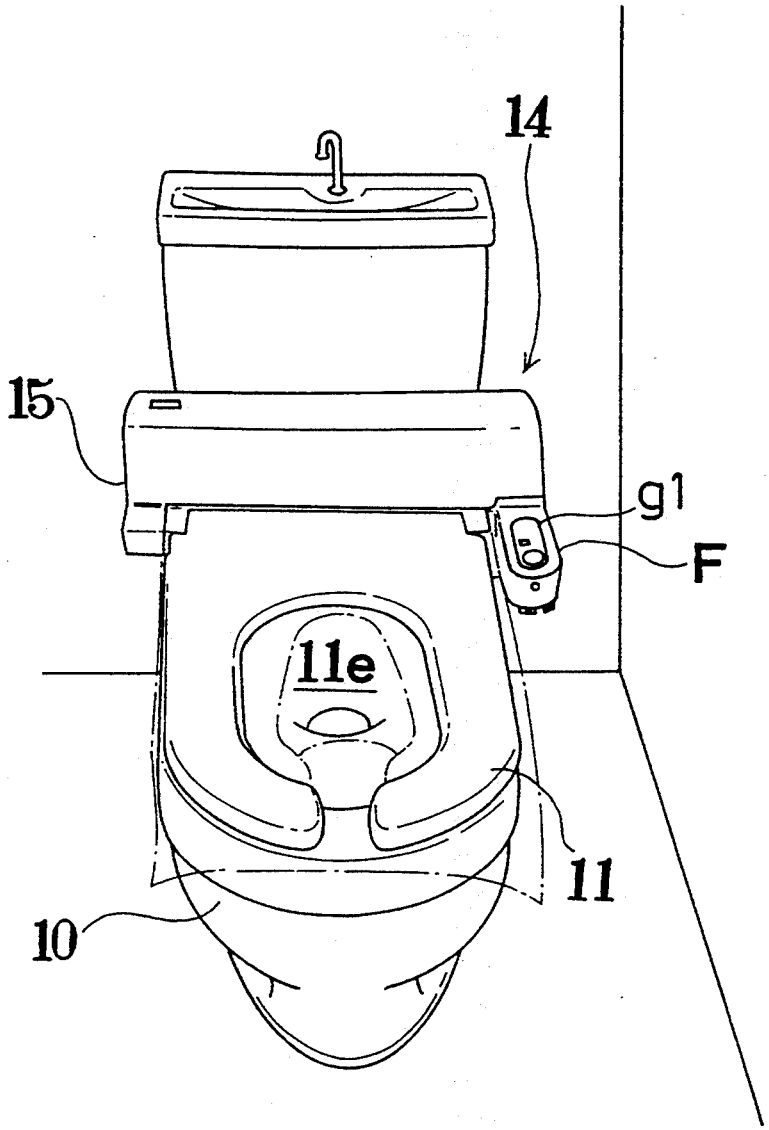
FIG. 1 is a perspective view of toilet equipment provided with a toilet seat with an automatic seat covering paper feeding apparatus according to the present invention.
Figure 2:
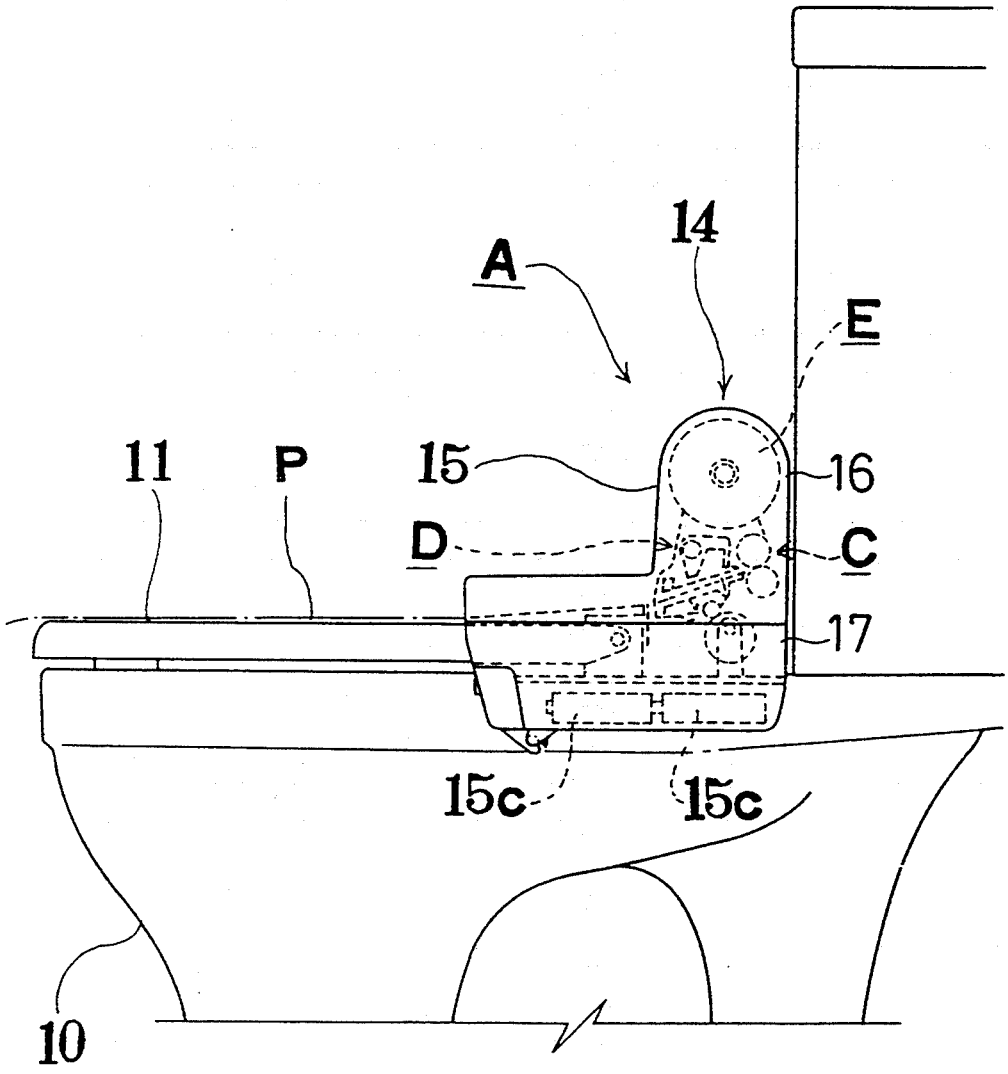
FIG. 2 is a side elevational view of the toilet equipment of FIG. 1.
Figure 3:
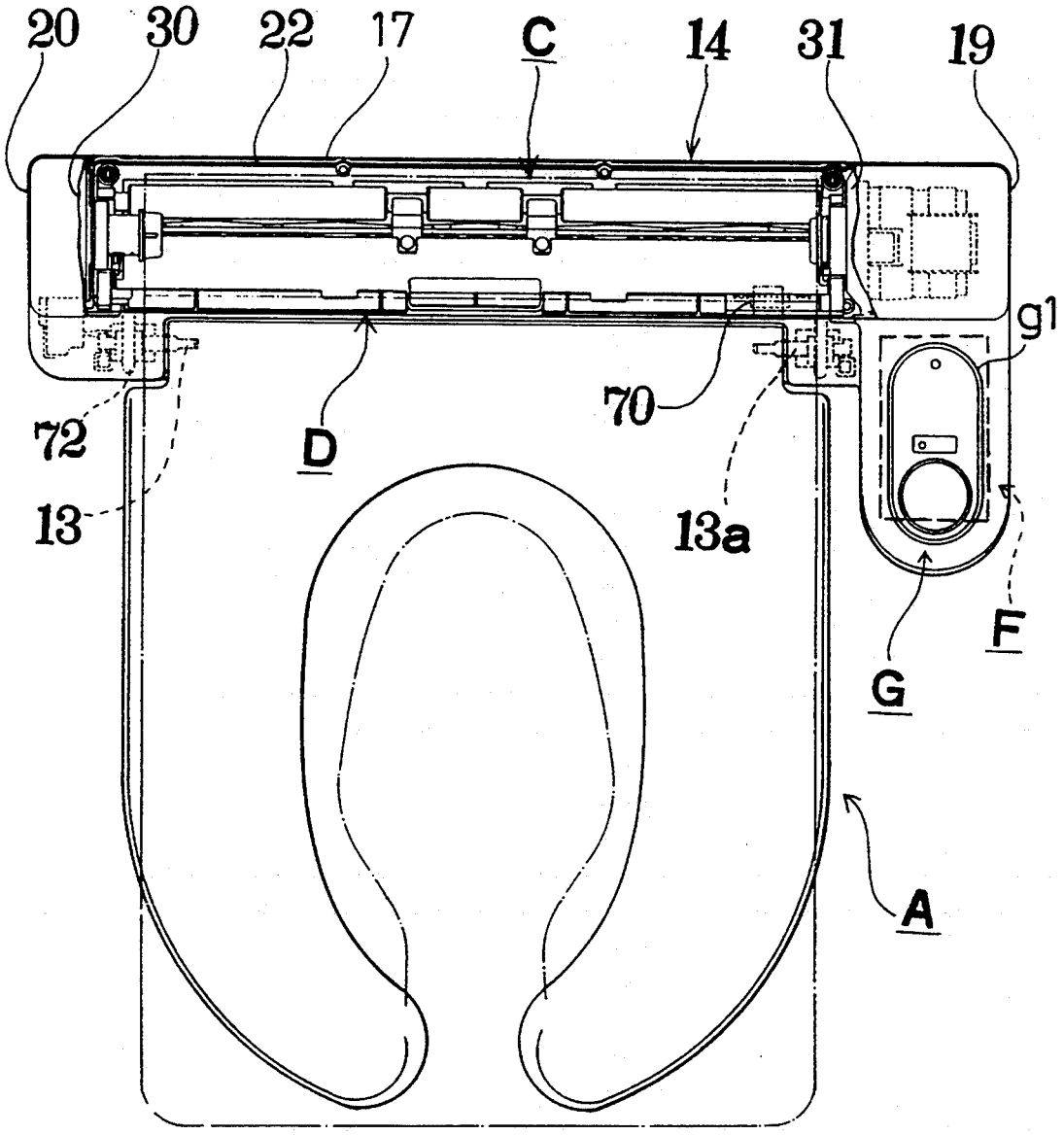
FIG. 3 is a partially cutaway plan view of the toilet equipment of FIG. 1.

As shown in FIG. 1 to FIG. 3, a toilet seat with an automatic seat covering paper feeder A comprises a toilet seat body 11 operatively mounted on a flush toilet bowl 10 for opening and shutting and a functional portion 14 fixedly mounted on the rear portion of the flush toilet bowl 10 for pivotably supporting the rear portion of the toilet seat body 11 for rotation around a functional shaft 13 and a simple shaft 13*a* between a horizontal and a vertical position.

The toilet seat body 11 is shaped in an oval ring with an opening 11*e* in the center. The functional shaft 13 is operatively interlocked with a later described seating detection sensor 72.

Figure 4:
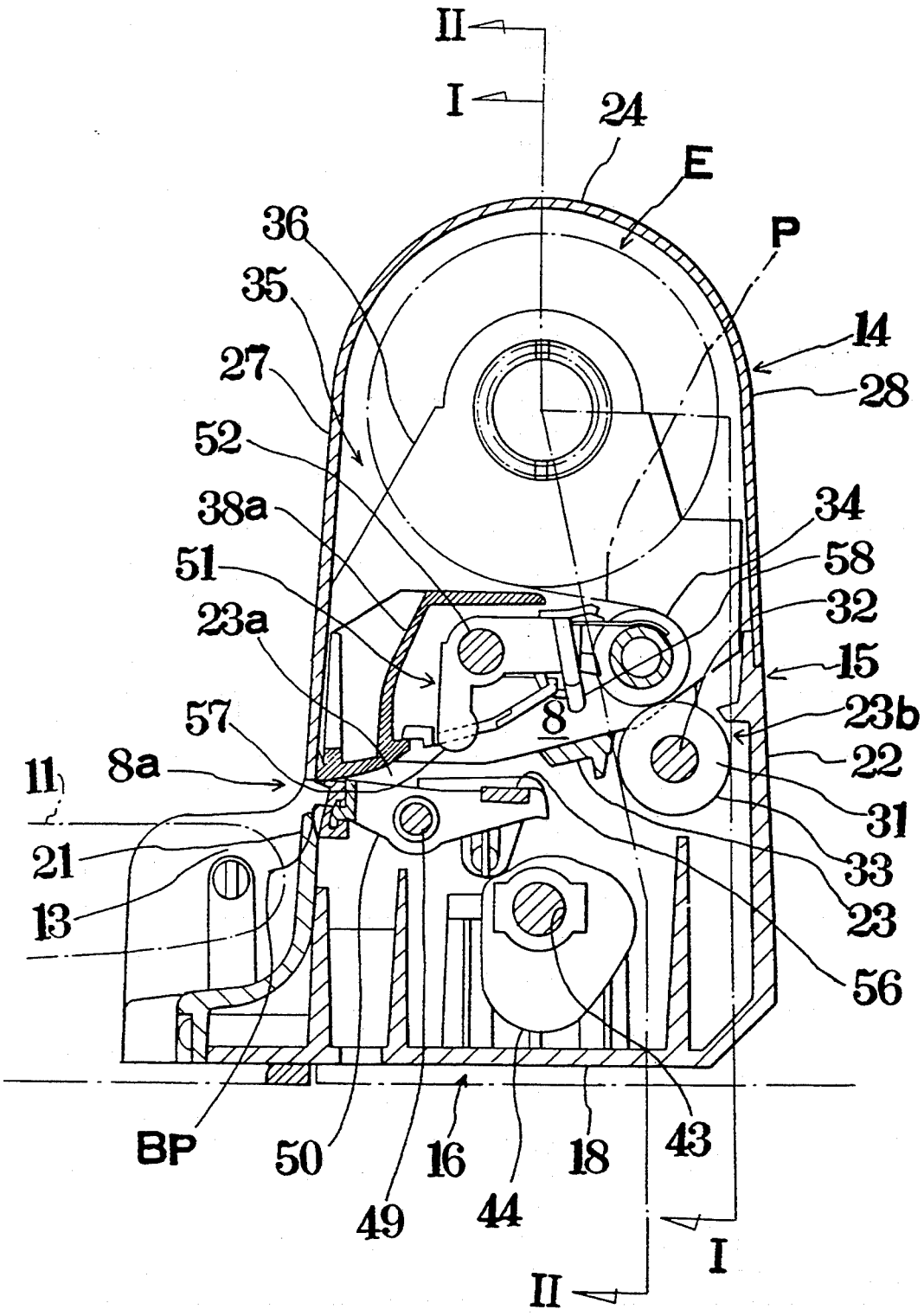
FIG. 4 is a partially cutaway right-hand side view of the automatic seat covering paper feeding apparatus.

The functional portion 14 is formed, as shown in FIG. 2 to FIG. 4, of a functional casing 15 attached to the rear portion of the flush toilet bowl 10A feeding mechanism C, a cutting mechanism D, a roll storage portion E, a control unit F, an operation portion G, and a dry battery case 15*a* are disposed within the functional casing 15.

Referring to FIG. 2 to FIG. 6, the functional casing 15 is formed of a lower casing 16 incorporating the feeding mechanism C, the cutting mechanism D, etc., and an upper casing 17 engaged with the top edge portion of the lower casing 16 and having the roll storage portion E formed therein.

Figure 5:
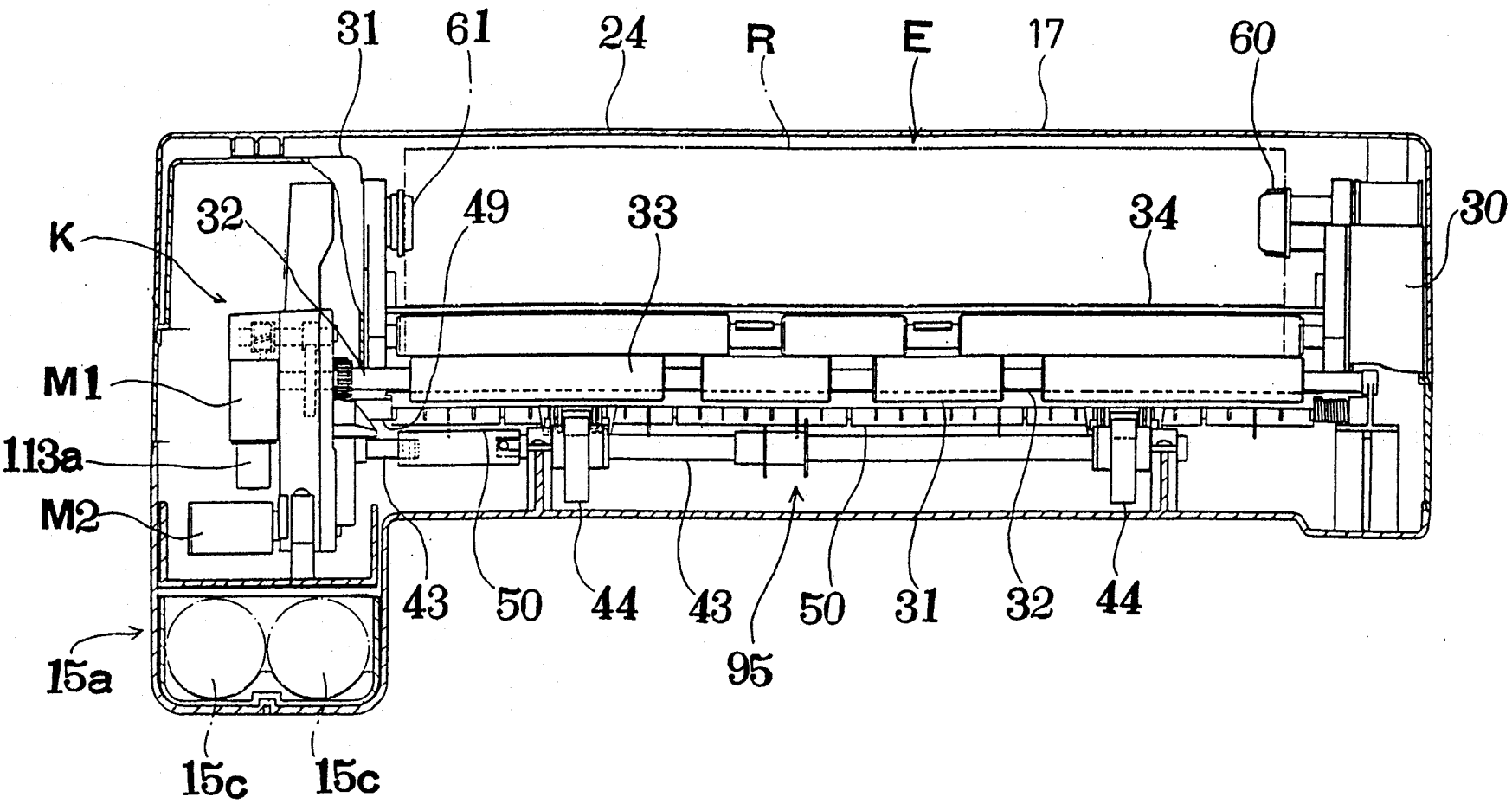
FIG. 5 is a cross-sectional view of the paper feeding apparatus in the direction of the arrow I—I in FIG. 4.

As shown in FIG. 5, on both left and right sides of the lower casing 16, there are erected left and right bearing boxes 30 and 31. In right bearing box 31 are disposed a feeding motor M1, for driving the feeding mechanism C and cutting mechanism D, and a cam-driving motor M2.

Figure 6:
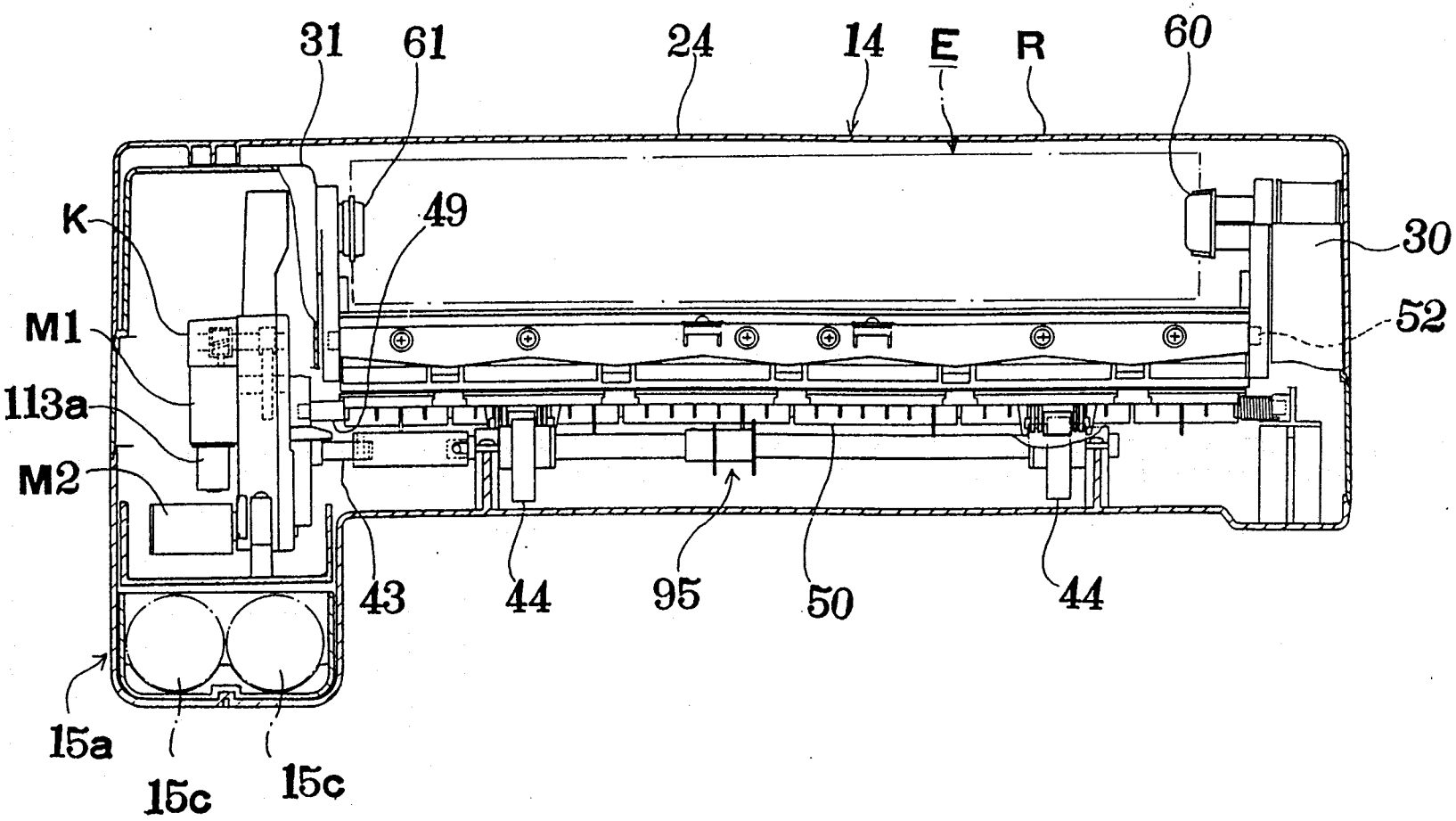
FIG. 6 is a cross-sectional view of the paper feeding apparatus in the direction of the arrow II—II in FIG. 4.

The feeding mechanism C includes, as shown in FIG. 4 to FIG. 6, a feeding shaft 32 coupled with the feeding motor M1 and transversely disposed between upper rear portions of the bearing boxes 30 and 31. The feeding shaft 32 has a feeding roller 33 fixedly attached thereto. Feeding roller 33 and a presser roller 34 disposed thereabove are adapted to sandwich the seat covering paper P therebetween, exerting a pressure thereon, and feeding the seat covering paper P from the roll storage portion E onto the toilet seat body 11.

Figure 7:
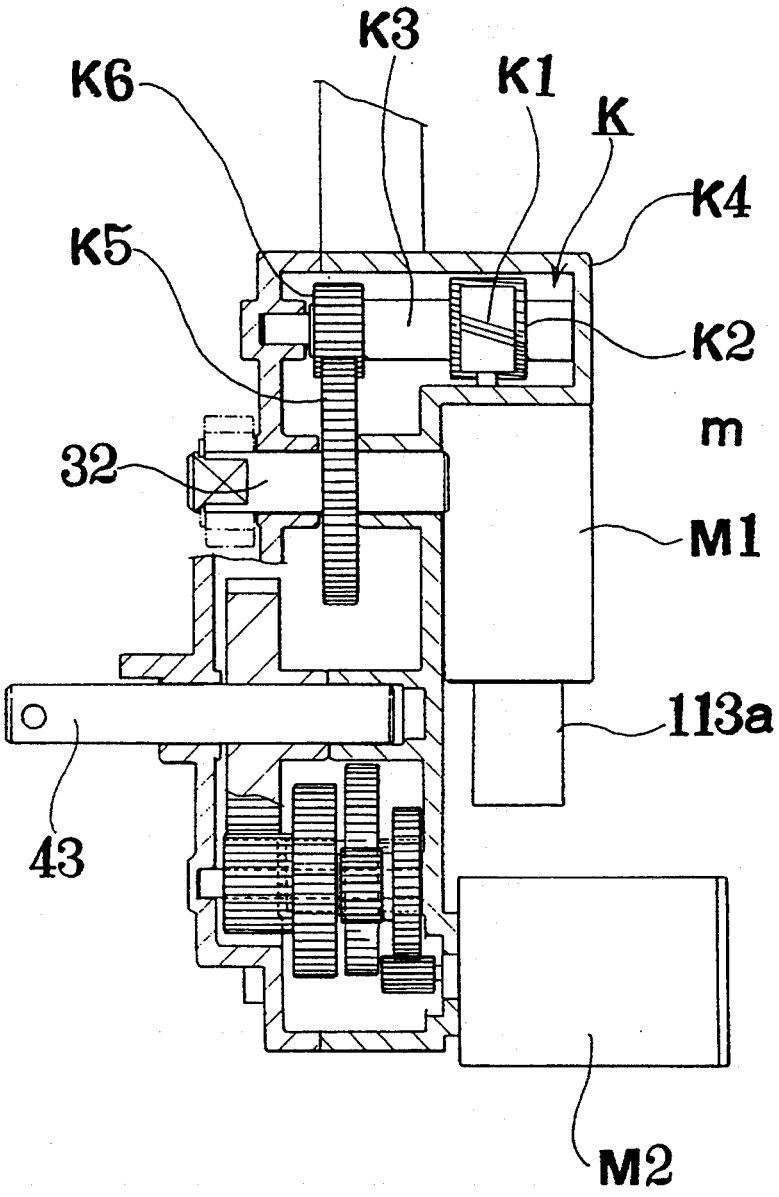
FIG. 7 is an enlarged elevational view of power transmission mechanism for the paper feeding and cutting mechanisms.

Between the feeding motor M1 and the feeding shaft 32 is interposed a power transmitting mechanism as shown in FIG. 5 to FIG. 7.

The power transmitting mechanism K shown in FIG. 7 encases a worm gear, made of a worm pinion K1 and a wormwheel K2, which works as a speed reduction as well as a reverse rotation preventing mechanism in a power transmission case K4.

Rotating power is transmitted from the output shaft m of the feeding motor M1 to the feeding shaft 32 by way of the worm gear.

That is, the power transmission case K4 has an inverse-L-shaped configuration and encases the feeding motor M1 at the lower end of the horizontal casing of the inverse-L-shaped configuration. The output shaft m of the feeding motor M1 is connected to the worm pinion K1. The worm pinion K1 and wormwheel K2 are encased in the horizontal casing in a meshed condition. An intermediate shaft K3, which is connected to the wormwheel K2, is horizontally disposed in the horizontal casing. The intermediate shaft K3 and the feeding shaft 32, horizontally disposed in the longitudinal casing of the inversely-L-shaped configuration, are operably connected by the meshed construction of the gears K5, K6.

Figure 27:
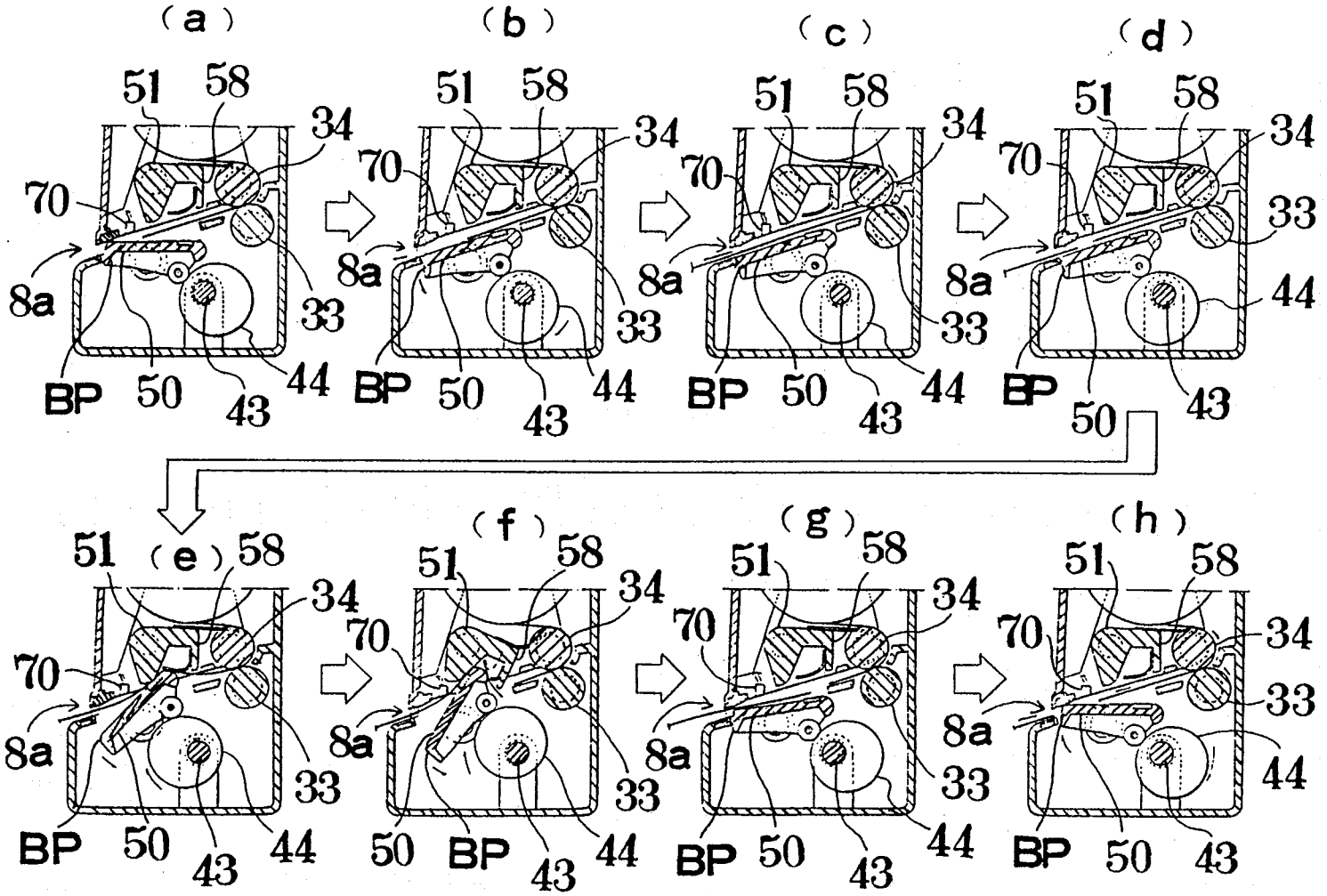
FIG. 27 is an explanatory diagram of operational positions of the paper feeding apparatus of FIG. 4.

Accordingly, although the rotation is transmitted from the feeding motor M1 to the feeding shaft 32, the transmission of the rotation from the feeding shaft 32 to the feeding motor M1 is prevented by frictional resistance of the worm gear so that an irregular rotation of the feeding roller 33 caused by any external force, such as a tension force exerted at the time of cutting of the seat covering paper P as shown in FIG. 27 cannot take place.

Figure 13:
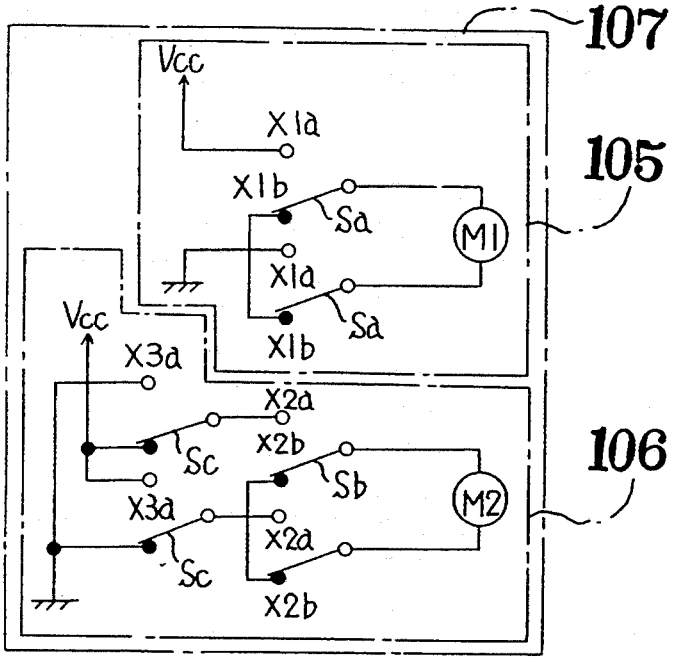
FIG. 13 is a circuit diagram of a motor driving circuit.

Furthermore, as shown in FIG. 13, both terminals $X_{1b}$, $X_{1b}$ of the feeding motor M1 are connected to the power source by way of a relay.

Accordingly, when the power source is off, halting power to motor M1, the terminals $X_{1b}$ are short-circuited by the relay, generating a braking force that rapidly stops the rotation of the output shaft of the feeding motor M1, thereby accurately regulating the stop position of the feeding roller 33.

Furthermore, since both terminals $X_{1b}$, $X_{1b}$ of the feeding motor M1 are short-circuited, when the external force that tends to rotate the feeding roller 33 occurs, for example, upon cutting of the seat covering paper P by applying tension thereto, an induction voltage is generated within the feeding motor M1, making the feeding motor M1 self-regulate to prevent irregular rotation of the feeding roller 33.

In this manner, by preventing the irregular rotation of the feeding roller 33 caused by any external force and accurately regulating the stop position of the feeding roller 33, the amount of the seat covering paper P that is fed can be accurately regulated. Thus breaking perforations c (described below) are accurately aligned with a cutting portion 58 of the cutting mechanism D.

Thus, a considerable external force must be applied to cut the seat covering paper P at parts other than the perforations. Cutting is therefore effected readily and accurately at breaking perforations c.

The cutting mechanism D, shown in FIG. 4 and FIG. 6, includes a disc cam 44 fixed to a power transmission shaft 43 coupled with the cam-driving motor M2. Cutting mechanism M2 is disposed for swinging around a shaft 49 and having its outer face engaged with the outer face of the disc cam 44. A swing plate 51 is disposed above the movable plate 50 and pivotably supported on a shaft 52. A presser piece 56 is disposed at the rear of the top face of the movable plate 50. Presser piece 56 and a presser piece 57 forming the front portion of the swing plate 51 cooperate in clamping the seat covering paper P. At the rear of the swing plate 51, cutting portion 58 is integrally formed with the presser piece 57. A barrier BP is fitted to the front portion of the top end of the movable plate 50 for preventing contaminated water from getting inside.

The roll storage portion E, shown in FIG. 4, FIG. 5, and FIG. 6, has roll holders 60 and 61 disposed on bearing boxes 30 and 31, so that a seat covering paper roll R, formed by winding the seat covering paper P around a paper cylinder R' many times, is removably supported thereon.

The construction of the seat covering paper roll storage portion E is further described in detail.

Figure 11:
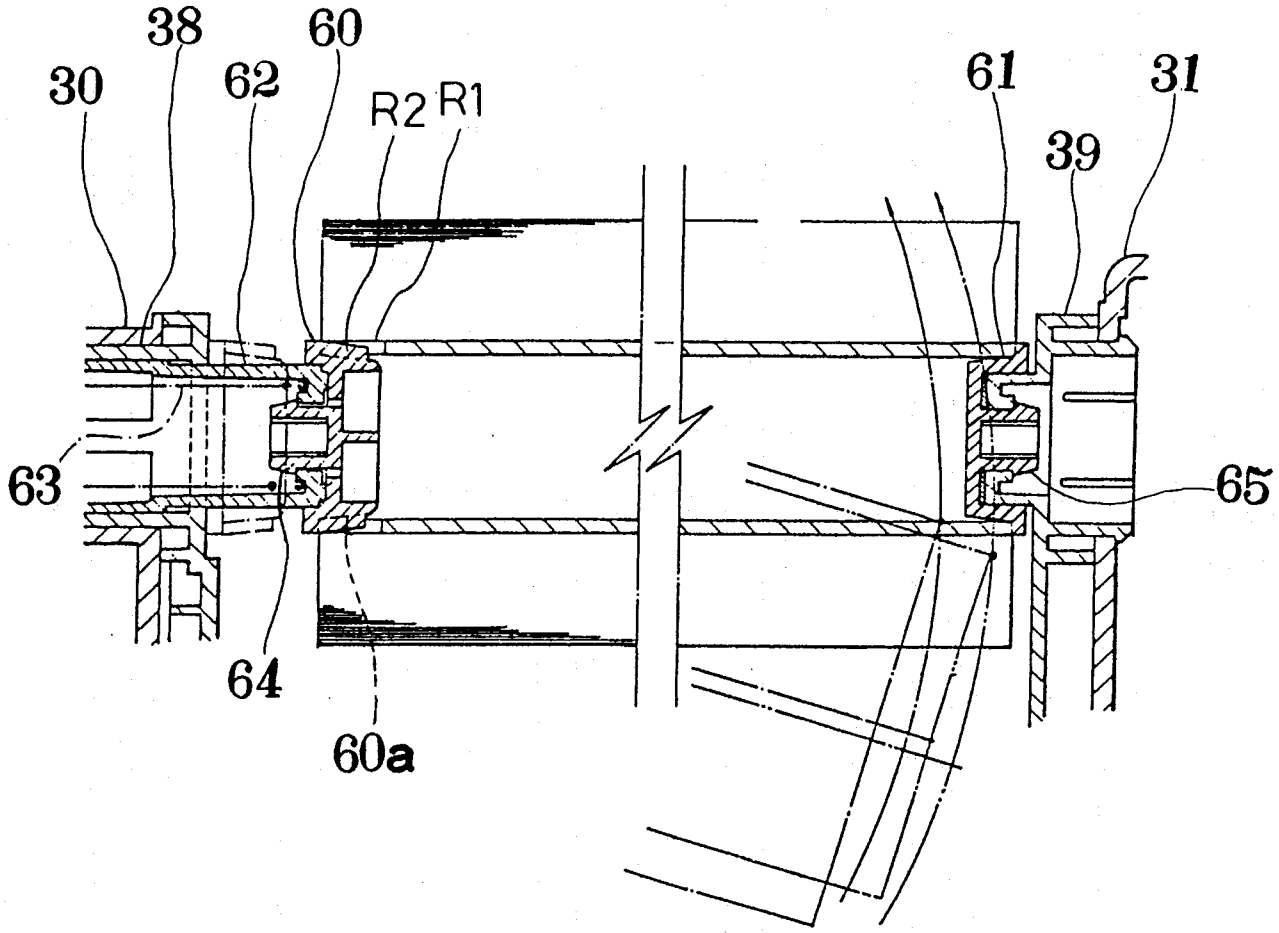
FIG. 11 is a depiction of the manner of replacing seat covering paper roll.

As shown in FIG. 11, a sleeve 38 is rotatably supported within bearing box 30, and the distal end of the holder mounting sleeve 62 is rotatably and reciprocably disposed within the sleeve 38.

The holder mounting sleeve 62 stores a spring 63 therein that biases the holder mounting sleeve 62 towards seat covering paper roll R.

The holder mounting sleeve 62 rotatably receives a seat covering paper holder 60 at the extended end thereof by means of a removable preventing plug 64.

At the opposite end of seat covering paper roll R, a sleeve 39 rotatably disposed in the bearing box 31 holds seat paper roll holder 61 in place with a removable preventing plug 65.

By compressing the spring 63 to retract the holder mounting sleeve 2 and seat paper roll holder 60, both ends of a paper sleeve R1 of the seat covering paper roll R can be supported by the seat paper roll holders 60, 61.

Furthermore, when the seat covering paper P on the paper sleeve R1 is used up, the spring 63 is compressed to retract the holder mounting sleeve 62 and seat paper roll holder 60. Both ends of the paper sleeve R1 of the seat covering paper roll R can then be removed from the seat paper roll holder 60, 61, as shown by dashed-dotted lines in FIG. 11, enabling the ready replacement of the seat covering paper roll R.

Figure 12:
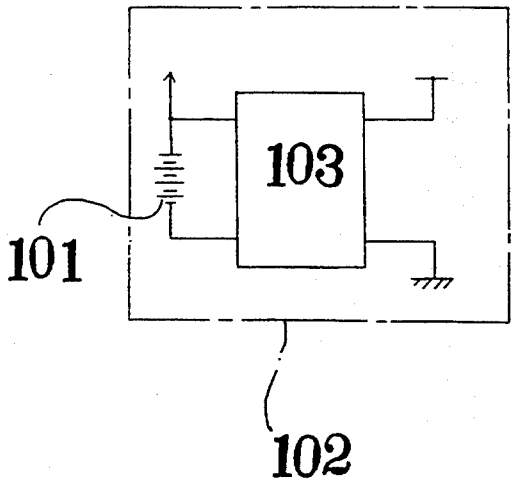
FIG. 12 is a circuit diagram of a power supply circuit.
Figure 14:
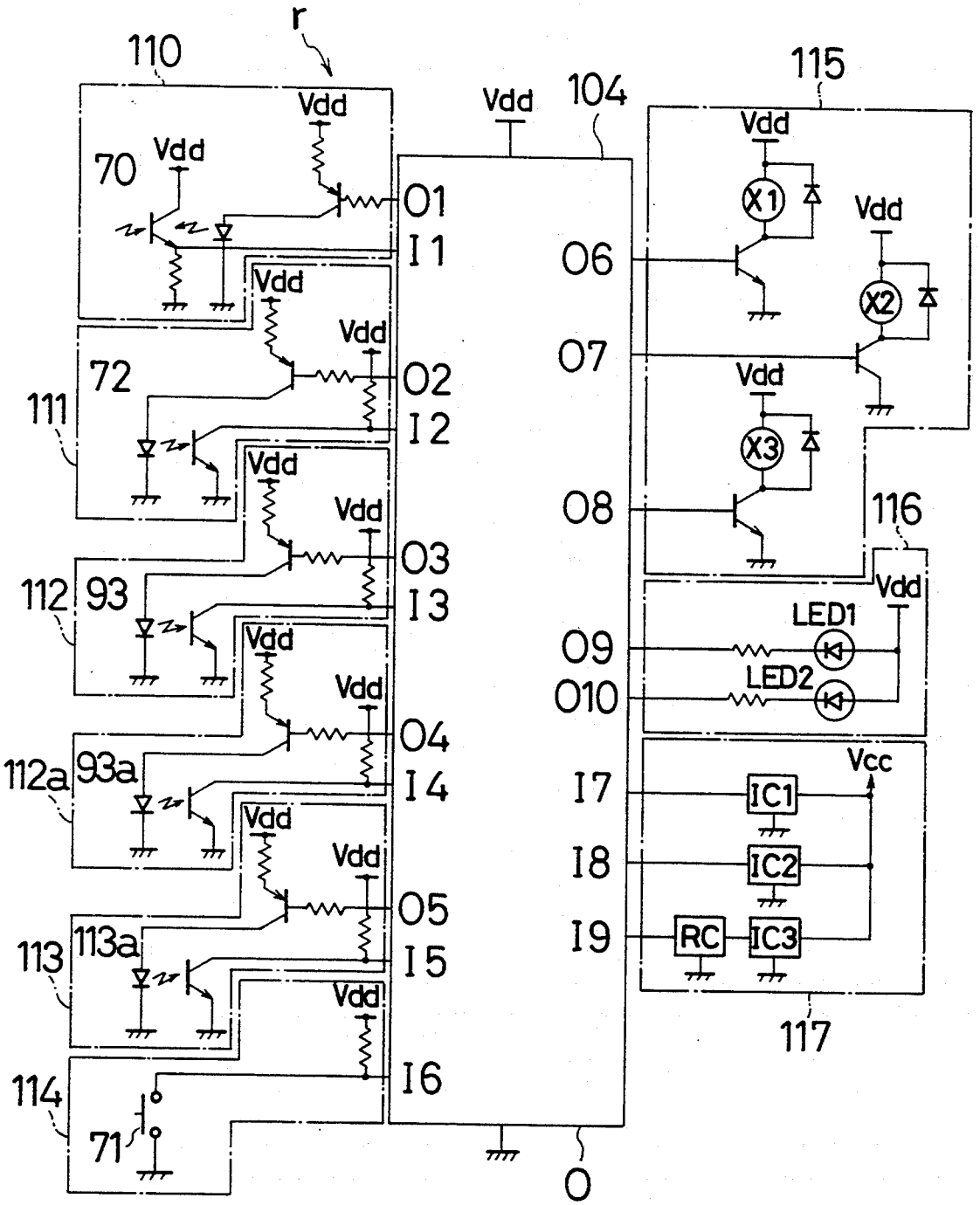
FIG. 14 is a circuit diagram showing the state of connections between a micro compressor and various circuits.

The control unit F, shown in FIG. 12 to FIG. 14, includes a power supply circuit 102, various circuits connected to the input and output terminals of a microcomputer 104, and a motor driving circuit 107. Motor driving circuit 107 includes first and second motor circuits 105 and 106 having contacts of relays provided in the aforesaid various circuits, and it further includes an interface, comprising inputs and outputs I1, O1–I9, O9 and O10, connected with control output generating means, such as a paper position detection sensor 70 that generate an output upon detecting an alignment hole b formed in the seat covering paper P (see FIG. 22), as well as a feed switch 71 and a seating detection means 72, (see FIG. 11) etc., provided in an operation portion G, (see FIG. 8), an output interface connected with the feeding mechanism C, cutting mechanism D, etc., a memory for storing seat covering paper P's feeding, clamping, and cutting programs, and a timer.

Figure 10:
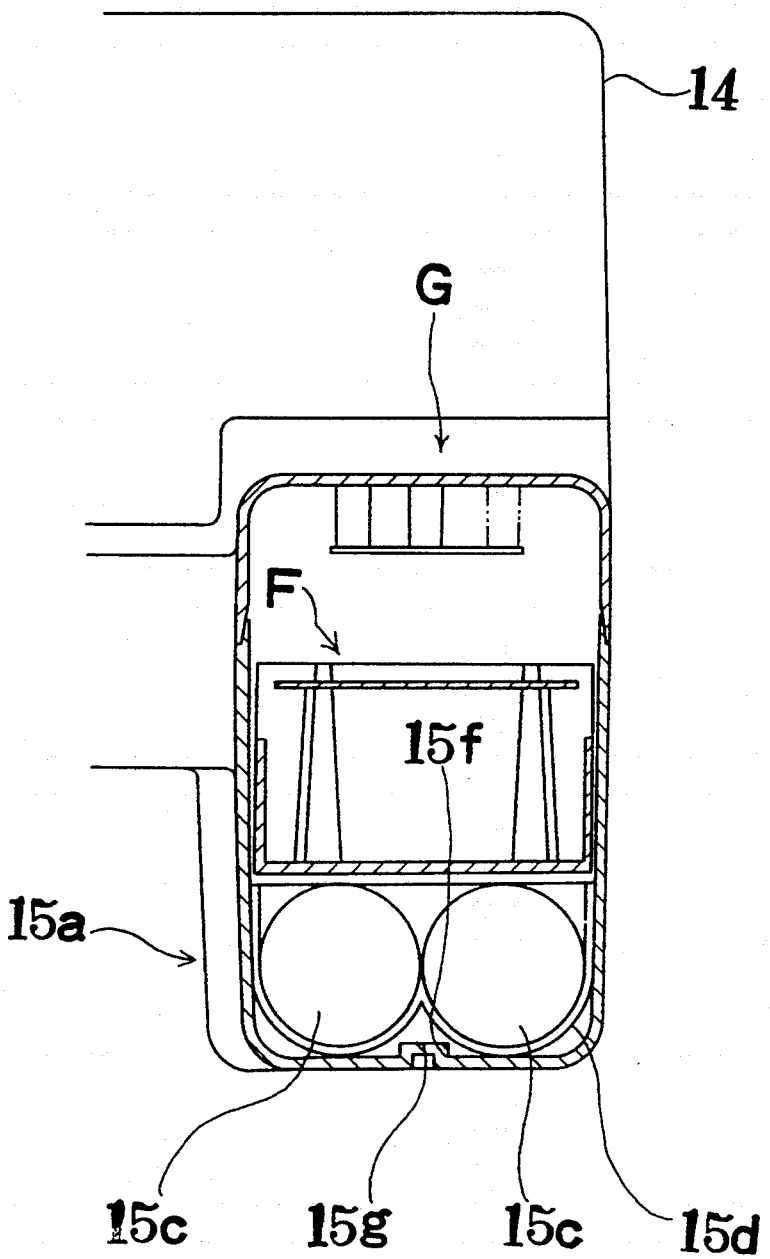
FIG. 10 is a cross sectional view of the paper feeding apparatus.

The operation portion G is, as shown in FIG. 1, FIG. 3, and FIG. 10, provided above the forward right portion of the lower casing 16 and includes feed switch 71, a power supply lamp formed of a light emitting diode or the like, and a display portion g1 that includes a paper trouble lamp with an alarm function triggered by an abnormal condition such as paper clogging, paper out, etc.

Figure 8:
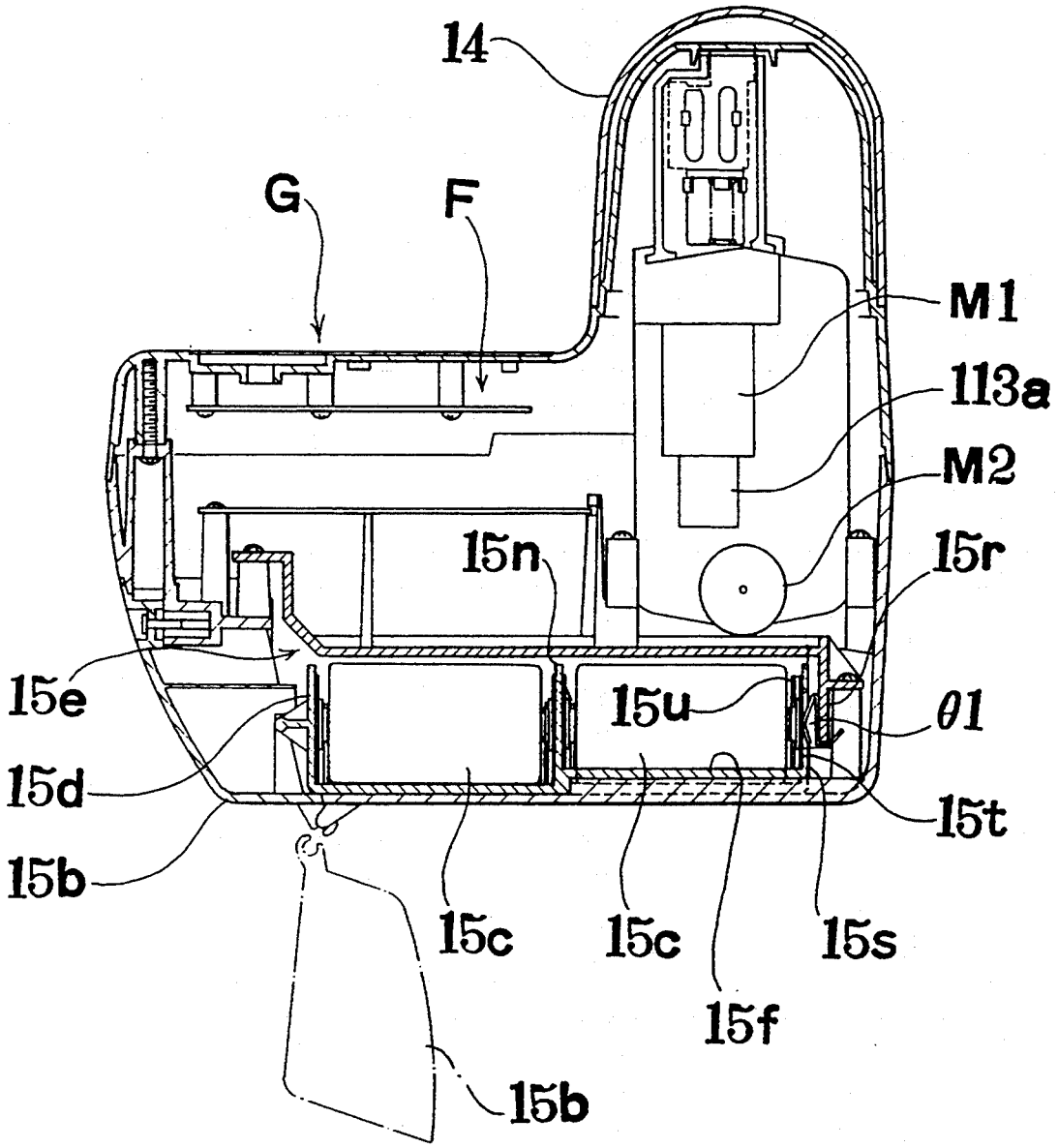
FIG. 8 is a cutaway right-hand side view of the paper feeding apparatus of FIG. 4 showing battery case storing a plurality of batteries therein.
Figure 9:
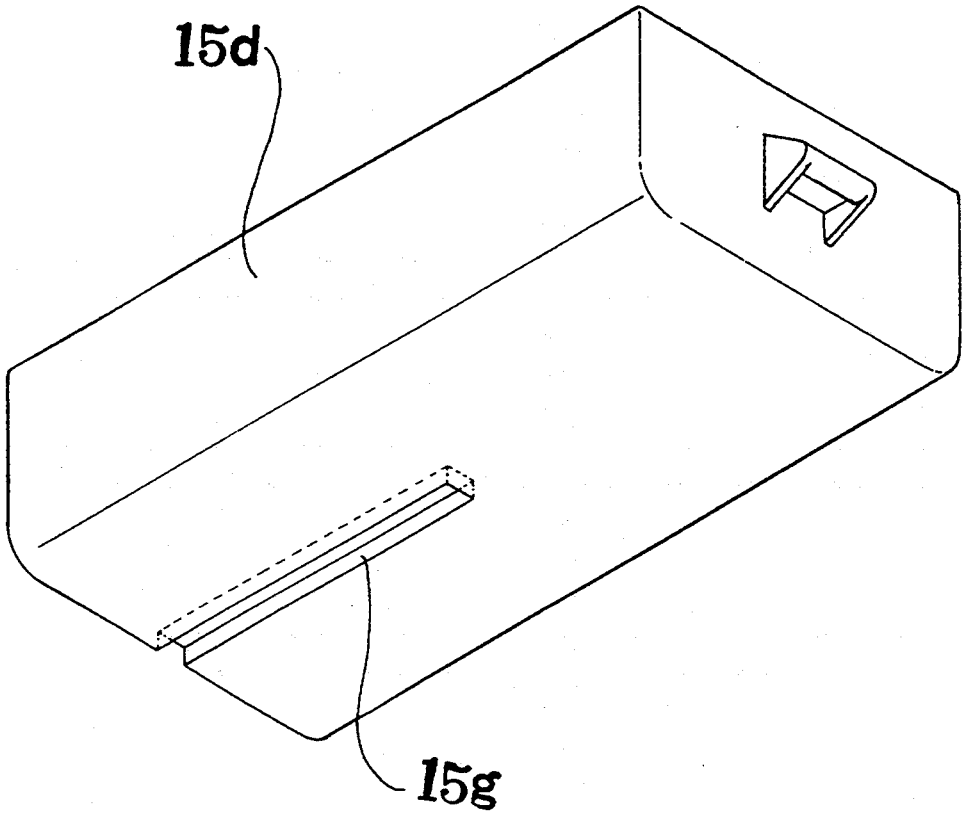
FIG. 9 is a perspective view of cartridge storing the batteries.

Below the operation portion G, as shown in FIG. 8 to FIG. 10, a dry battery case 15a capable of containing four 'single type No. 1' dry cells 15*c*, is formed integral with the lower casing 16. Electric power for driving the mechanisms C and D and the control unit F is supplied from the dry battery 101 in the dry battery case 15*a* which has a cover 15*b* for opening and shutting.

The battery case 15*a* forms a cartridge insertion opening 15*e* of an approximately rectangular shape at the front wall thereof through which a cartridge 15*d* can be stored.

The cartridge 15*d* has, as shown in FIG. 8 and FIG. 9, an approximately box-like construction with its upper end open. The cartridge 15*d* is divided into several chambers by a plurality of partition walls, and a battery 15c is accommodated in each chamber.

Figure 9A:
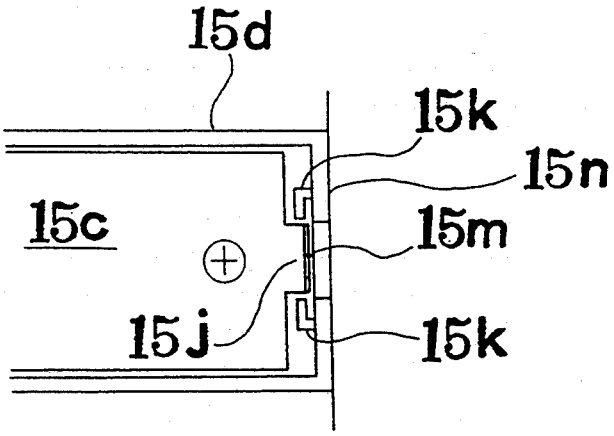
FIG. 9A(*a*) is a partial plan view of the battery case.
Figure 9A:
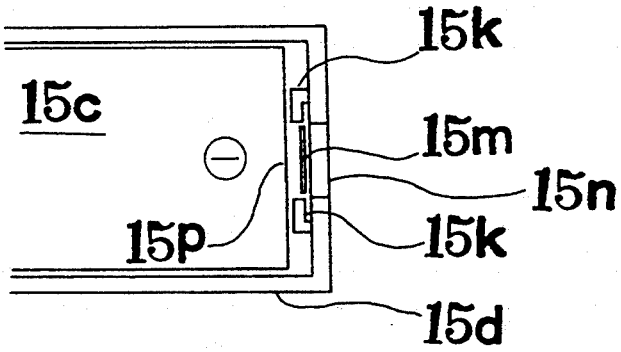

Referring to FIG. 9A, on the partition wall 15*n* which faces the positive pole of each battery 15*c*, a pair of left and right protrusions 15*k* are formed with a contact 15m between them. Therefore, when the battery 15c is correctly inserted into the chamber (FIG. 9A(*a*)), the positive pole 5j of the battery 15c comes into contact with the contact 15m, while, when the battery 15c is incorrectly inserted into the chamber (FIG. 9A(*b*)), the negative pole 15p of the battery 15c does not come into contact with the contact 15m, so that a wrong connection from the incorrect insertion of the battery 15c can be prevented.

Furthermore, as shown in FIG. 9 and FIG. 10, the cartridge 15d is provided with an elongated guide groove 15g on the rear half portion of the outer bottom surface thereof, while an elongated guide protrusion 15f is formed on the rear half portion of the inner bottom surface of the battery case 15a. Therefore, when the cartridge 15d is to be inserted into the cartridge case 15a in an incorrect manner, the guide protrusion 15f bumps into the front wall of the cartridge 15d so that the latter can only be inserted correctly through the cartridge insertion opening 15e, thereby preventing incorrect insertion of the cartridge 15d.

In this manner, by preventing incorrect insertion of the battery 15c into the cartridge 15d and the wrong insertion of the cartridge 15d into the cartridge insertion opening 15e, a wrong connection when the battery is replaced can be prevented.

Furthermore, as shown in FIG. 8, on the rear wall 15r of the cartridge insertion opening 15e and the rear wall of the cartridge 15d, a cartridge side contact 151 and a case side contact 15u are mounted. The case side contact 15u is a resilient metal plate with a corrosion-resistant coating folded in an approximately U-shaped contour with a freely variable opening angle $\theta 1$.

Upon insertion of the cartridge 15d into the battery case 15a, the case side contact 15u is resiliently reformed whereby a relative slide movement between the contacts 15t and 15u removes any oxide or corrosion film formed on the surface of the contacts 151, 15u at each inserting operation, assuring a favorable electrical connection between the cartridge 15d and the battery case 15a.

Figure 9B:
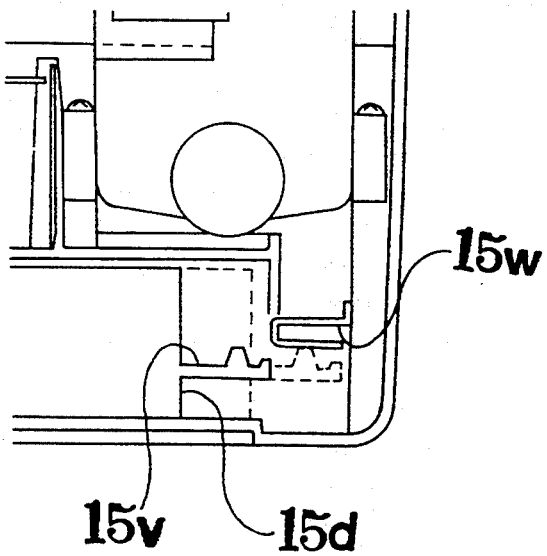
FIG. 9B is a partial elevational view of the modified battery case.

FIG. 9B discloses an alternative configuration to the above battery construction wherein, upon insertion of the cartridge 15d, a cartridge-side contact 15v slides on the surface of a case-side contact 15w to clean the surfaces of contacts 15v, 15w.

Figure 15:
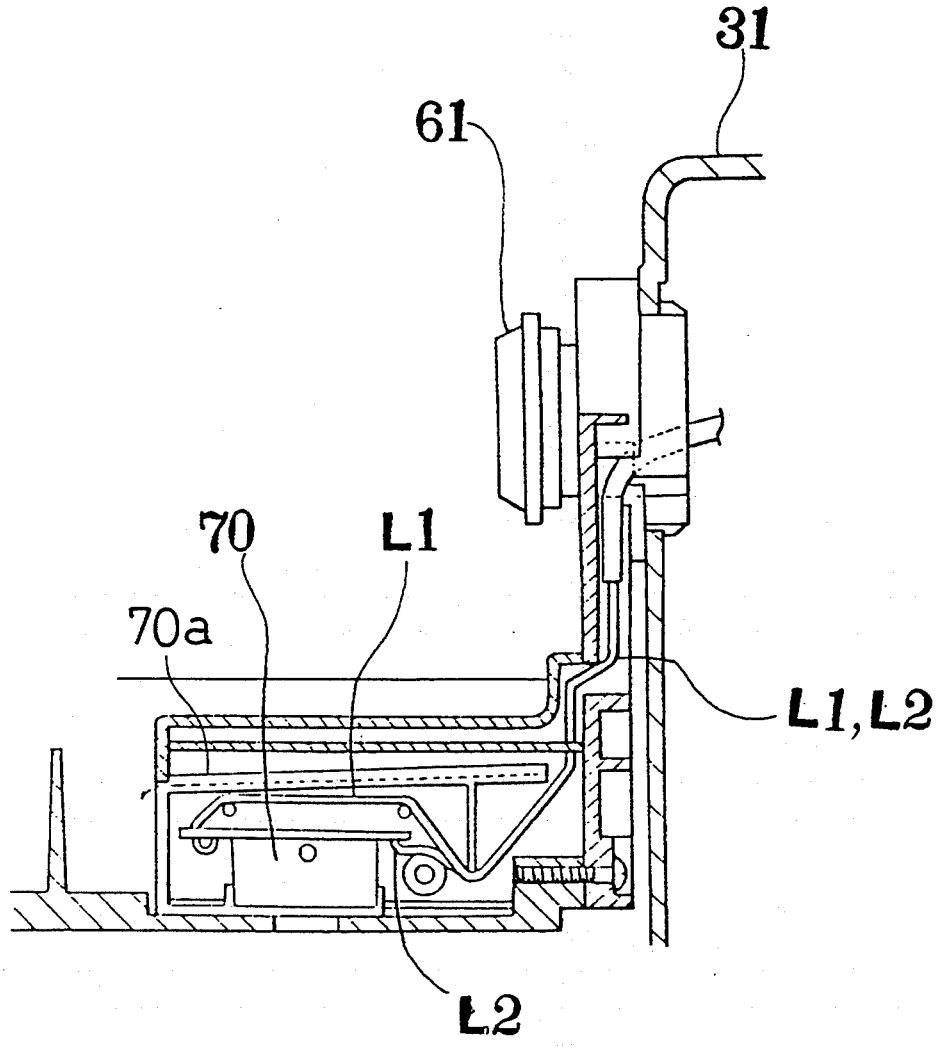
FIG. 15 is an enlarged cutaway elevational view of the paper position detection sensor.

On the forward right side of the functional casing 15, there is disposed, as shown in FIGS. 3, and 15, a paper position detection sensor 70, which includes a phototransistor and a photodiode. The paper position detection sensor 70, when the seat covering P is fed a predetermined length from the seat covering paper roll R onto the toilet seat body 11, detects the alignment hold b formed in the seat covering paper P at predetermined intervals (see FIG. 22) and thereupon stops the operation of the feeding mechanism C so that the seat covering paper P is accurately fed onto the toilet seat body 11.

That is, when the seat covering paper P is fed on to the toilet seat body 11 from the seat covering paper roll R to a predetermined length by activating the seat covering paper feeding mechanism C, the seat covering paper position detection sensor 70 detects the alignment hole b, stops the operation of the seat covering paper feeding mechanism, and thereby assures accurate feeding and locating of the seat covering paper P on the toilet seat body 11.

In this embodiment, as shown in FIG. 15, the seat covering paper position detection sensor 70 is covered by a waterproof cover 70a, and the electric connection between the sensor 70 and the control unit F disposed on the front right portion of the lower casing 16 is made through a pair of lead wires L1, L2 which pass through a cylindrical boss 39.

The seating detection sensor 72 is seated by sensing the weight on the toilet seat body 11. Both ends of the rear portion of the toilet seat body 11 are removably fitted, for rotation and standing upright, to pivotal support portions 15d on both sides of the front portion of the functional casing 15 through the functional shaft 13 and simple shaft 13a. The sensor is operatively interlocked with the functional shaft 13 disposed within the pivotal support portion 15d.

Figure 16:
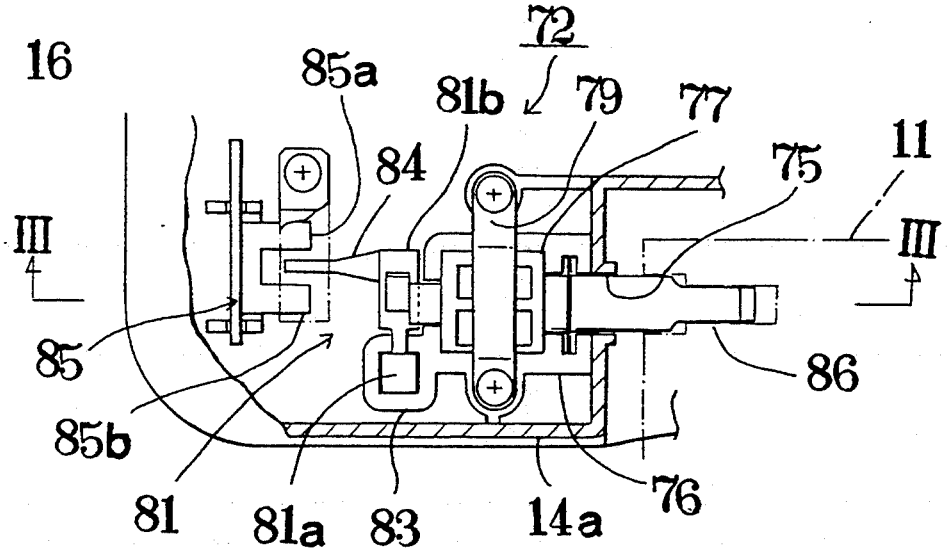
FIG. 16 is an enlarged plan view of the paper position detection sensor.
Figure 17:
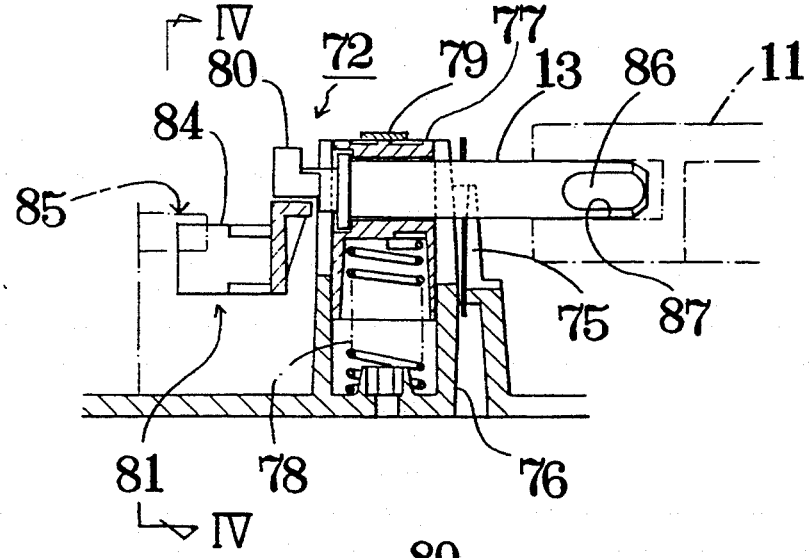
FIG. 17 is a cross sectional view in the direction of the arrow III—III in FIG. 16.
Figure 18:
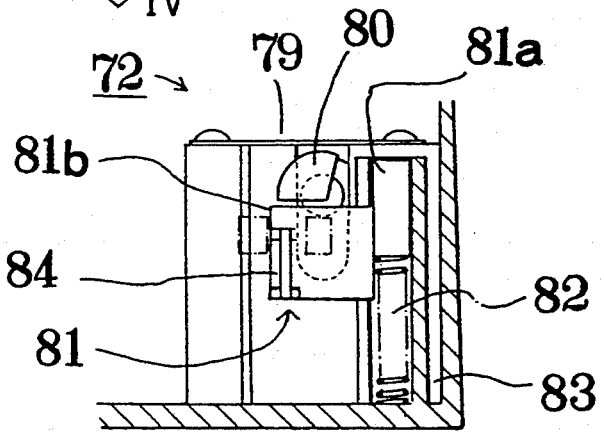
FIG. 18 is a cross sectional view in the direction of the arrow IV—IV in FIG. 17.

Such a seating detection means 72 is explained in detail in view of FIG. 16 to FIG. 18.

Referring to FIG. 13 and FIG. 16, both rear ends of the seat body are fitted by a functional pivot shaft 13 and a simple pivot shaft 13a, to pivot portions 15a, 15b provided on both front ends of the functional unit casing 15, to swing upward and downward.

Further, the seating detection means 72 is disposed within the pivot portion 15a and connected to functional pivot shaft 13.

The functional pivot shaft 13, as shown in FIGS. 16 to 18, is inserted into the pivot portion 15a while passing through the hole 75 provided longitudinally on the inner wall 74 of the pivot portion 15a.

The portion inserted of the functional pivot shaft 13 is rotatably supported in a movable bearing 77 mounted elevatably within an elevation guide casing 76.

Although the movable bearing 77 is constantly biased upward by a coil spring 78, since the upper limit position is restricted by a restriction plate 79, the movable bearing 77 assumes normally an upper position (not a seated position) as shown in FIG. 17, and the functional pivot shaft 13 and the toilet seat body 11 assume an upper position as well.

The functional pivot shaft 13 has a lever pressing member 80 on the inserted extremity thereof. Referring to FIG. 18, the lever pressing member 80 is a segment of approximately a quarter circle coaxial with the functional pivot shaft 13. The radius of the outer periphery of the segment is considerably larger than the radius of the functional pivot shaft 13.

The shape of the lever pressing member 80 is not limited to the quarter circle segment. Any shape may be used if the radius of the outer periphery thereof is considerably larger than the radius of the functional pivot shaft 13.

Below the above-mentioned lever pressing member 80, a sensor activating lever 81, which has an L-shape when viewed in plan, is mounted.

The sensor activating lever 81 has a prodigal end 81a elevatably supported with an upward bias within a lever elevation guide casing 83 housing a coil spring 82 on the inside thereof and a distal end 81b with a shield plate 84.

Therefore the upper surface of the sensor activating lever 81 is kept constantly in contact with the lever pressing member 80 by the force of coil spring 82.

The above-mentioned shield plate 84 is interposed between a light emitting device 85a and a light receiving device 85b of an infrared sensor 85 provided within the pivot portion 15a of the functional unit casing 15.

When the user sits on the seat body 11, the functional pivot shaft 13, the movable bearing 77 and the lever pressing member 80 are integrally lowered by the user's weight against the force of the coil spring 78. Concurrently with this lowering, the sensor activating lever 81 is also lowered to make the shield plate 84 release the shield of conduction between the light emitting device 85*a* and the light reception device 85*b*, thereby enabling the infrared sensor 85 to generate an ON signal.

When the user leaves the toilet seat body 11, the weight is eliminated. The functional pivot shaft 13, the movable bearing 77, and the lever pressing member 80 are integrally raised by the force of the coil spring 78, and concurrently with this raising, the sensor activating lever 81 is also raised by the force of the coil spring 82 so that the shield plate 84 stops the conduction between the light emitting device (photodiode) 85*a* and the light reception device (phototransistor) 85*b*, thereby enabling the infrared sensor 85 to generate an OFF signal.

The output of seating detection means 72 allows each mechanism for stopping the automatic feeding of the seat covering paper to perform any desired operation.

When the user leaves after sitting on the toilet seat body 11 and a predetermined time passes, the seating detection means 72 generates a detection output signal to operate the control unit F and to release the clamping of the seat covering paper P by using the seat covering paper cutting mechanism C.

When the user removes the used seat covering paper P, the signal of the seat covering paper position detection sensor 70 helps the movable plate 50 to rotate, thus preventing contaminated water from entering into the seat covering paper feeding path 8.

Further, while the user is still sitting on the toilet seat body 11, the seating detection means 72 prevents the seat covering paper P from being fed out even if the seat covering paper feeding button switch 71 is pressed down.

In this embodiment, as shown in FIGS. 16 to 18, the seating detection means 72 functions as a seat body erection detection means as well.

That is, the functional pivot shaft 13 has a seat body engaging portion 86 with a flat cross section formed by cutting the side opposite the seat body. The seat body engaging portion 86 is mounted removably on the side corresponding to the rear portion of the toilet seat body 11 and inserted into a pivot shaft engaging hole 87 having the same shape as the seat body engaging portion 86.

Since there is no relative rotation between the toilet seat body 11 and the functional pivot shaft 13, when the toilet seat body 11 is rotated erect the functional pivot shaft 13 rotates integrally, thereby rotating the lever pressing member 80 on the inserting end of the functional pivot shaft 13.

Since the radius of the lever pressing member 80 is considerably larger than the radius of the functional pivot shaft 13, by the rotation of the lever pressing member 80, the functional pivot shaft 13, the movable bearing 77, and the lever pressing member 80 are lowered integrally against the force of the coil spring 78. Concurrently with such lowering, the sensor activating lever 81 is also lowered so that the shield plate 84 releases the shield of conduction between the light emitting device 85*a* and the light reception device 85*b*, thereby enabling the infrared sensor 85 to generate an ON signal.

On the other hand, when the toilet seat body 11 is returned from the erect to the level seating position, since the force of the lever pressing member 80 on the sensor activating lever 81 is released, the functional pivot shaft 13, the movable bearing 77, and the lever pressing member 80 are elevated integrally by the force of the coil spring 78. Concurrently with such elevation, the sensor activating lever 81 is also elevated by the force of the coil spring 82, so that the shield plate 84 provides the shield of conduction between the light emitting device 85*a* and the light reception device 85*b*, thereby enabling the infrared sensor to generate an OFF signal.

In response, the control unit F stops the operation of the seat covering paper feeding mechanism C when the toilet seat body 11 is erected thus preventing the seat covering paper P from being fed from the functional unit casing 15, even if the seat covering paper feeding switch 71 is pressed down erroneously or mischievously or there is twisting or clogging within the functional unit casing 15.

Referring to FIGS. 6, 7 and FIGS. 19 to 21, movable plate position detection sensors 93, 93*a* are juxtaposed in a sensor fitting box 95 at the bottom surface of the casing 94 in the vicinity of a power transmission shaft 43 to which a disc cam 44 is fixed.

Figure 20:
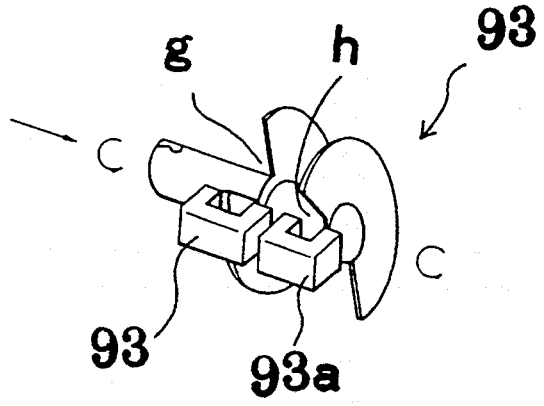
FIG. 20 is a perspective view of the sensor of FIG. 19.
Figure 21:
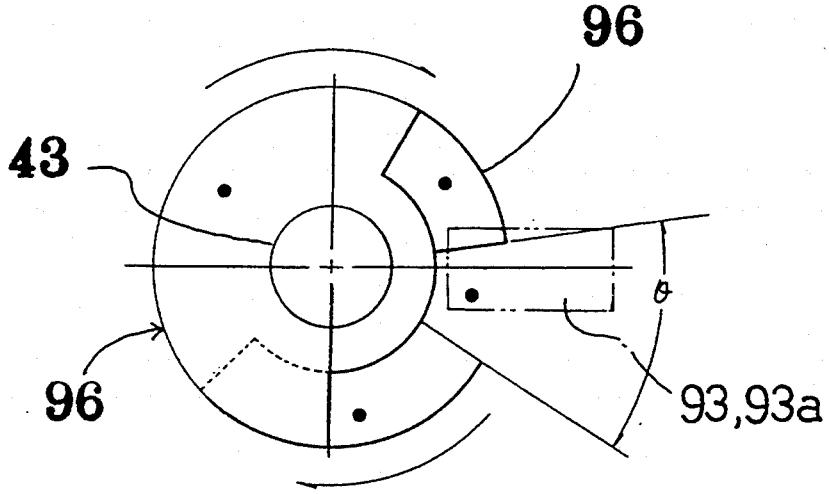
FIG. 21 is an explanatory diagram of the sensor of FIG. 19.

Movable plate position detection sensors 93, 93*a* are mounted so as not to interfere with the rotation of power transmission shaft 43. They are U-shaped when viewed in plan, as shown in FIGS. 20 and 21. The light emitting device (photodiode) and the light reception device (phototransistor) are mounted on walls facing the opening of the U-shape.

In the U-shaped portion of the movable plate position detection sensors 93, 93*a*, a pair of detection plates 96, 96*a* are loosely fixed to the power transmission shaft 43 with a predetermined space in the axial direction thereof.

Figure 19:
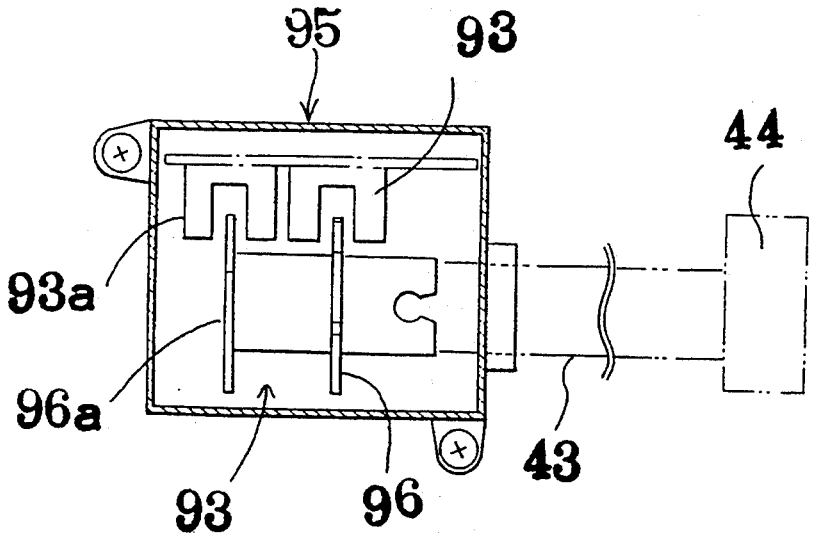
FIG. 19 is a plan view of a movable plate position detection sensor.

As shown in FIGS. 19 to 21, the detection plates 96, 96*a* are arc-shaped with portions g, h, which are about one third of a circle, cut away. Detection plates 96, 96*a* are fitted to the power transmission shaft 43 eccentrically in the circumferential direction so that the cut-away portions g, h form an angle $\theta$ of about 50 degrees.

Movable plate position detection sensors 93, 93*a* can detect the rotating position or the moving position of the movable plate 50 which moves concurrently with the disc cam 44 in response to the light-shielding or the light-emitting of the light emitting device caused by the rotation of the power transmission shaft 43.

That is, the rotation of the detection plates 96, 96*a*, cause the movable plate position detection sensors 93 93*a* to reliably detect when the movable plate 50 reaches each operational position a–h. FIG. 27 shows the order of operation of the seat covering paper automatic feeding toilet seat A (described below). This detection output activates the seat covering paper feeding mechanism C and the like to perform predetermined operations.

As mentioned above, the relationship between the positions of the movable plate position detection sensors 93, 93*a* and the detection plates 96, 96*a* (FIG. 21) and the positions of the above mentioned operations a–h (FIG>27) is shown in the following table.

| plate detected position | movable plate position detecting sensor | | seat covering paper feeding operation (position of movable plate) |
|---|---|---|---|
| | 93 | 93a | |
| | ON | OFF | FIG. 27 (a)(h) |
| | OFF | OFF | FIG. 27 (b)(c)(d) |
| | OFF | ON | FIG. 27 (f) |

-continued

| plate detected position | movable plate position detecting sensor | | seat covering paper feeding operation (position of movable plate) |
|---|---|---|---|
| | ON | ON | FIG. 27 (g) |

Referring to FIG. 21A, an incremental-type rotary encoder 113*a*, which optically carries out the detecting operation, is the operation amount detection means.

For detecting the revolution of the feeding motor M1, as shown in FIG. 14, the revolution detecting circuit 113 is connected to the input interface I5 of the microcomputer 104. The commercially available incremental-type rotary encoder 113*a* is employed as the revolution detecting circuit 113.

Referring to FIG. 5 and FIG. 6, the rotary encoder 113*a* is coaxially mounted on the rear portion of the feeding motor M1.

To explain the incremental-type rotary encoder briefly (See FIG. 21A), along with rotary shaft 113*a*-1, a disc 113*a*-2 on which black and white patterns are printed is rotated. Corresponding to this rotation of the disc 113*a*-2, the light either passes through an A-phase slit 113*a* and a B-phase slit 113*a*-5 or is shut off by the disc 113*a*-2. The light passed through the slits 113*a*-3, 113*a*-5 is transformed into electric current by means of phototransistors 113*a*-6 which face the respective slits to generate two rectangular-formed waves. The microcomputer 104 counts the output pulses and determines the number of revolutions of the motor M1 from the number of counts.

Since the incremental-type pulse signal cannot be recognized individually, the number of rotations of the input shaft from the reference position is measured by the number of pulses accumulated. Accordingly, any desired reference position can be chosen from which any number of revolution can be counted.

The two-phase signal slits 113*a*-3, 113*a*-5 generate one signal per revolution of the disc 113*a*-2. They are used as the origin of the coordinate axes. In FIG. 21A, the numeral 113*a*-7 denotes a photodiode.

Use of the rotary encoder 113*a* drastically reduces the consumption of electricity compared to a HOLL IC element. Thus if rotary encoder 113*a* is employed in the battery-driven apparatus for feeding seat covering paper P, even if the battery voltage is reduced the accurate detection of the revolution can be assured, thereby eliminating the inaccurate operation of the HOLL IC element, which requires a voltage close to the battery's maximum voltage.

The seat covering paper P, as shown in FIG. 22, has linear cutting perforations c in the transverse direction at intervals of predetermined length. It also has cutting perforations a that conform to the inner shape of the toilet seat body 11 in each of the portions between neighboring breaking perforations c. However, there is provided a perforation-free portion d between both of the rear ends of the cutting perforations a, so that, when the paper is cut along the perforations a, the center portion hangs down into the flush toilet bowl 10. Further, in one side edge portion of the seat covering paper P, there are provided alignment holes b at intervals of a predetermined length in the longitudinal direction. Furthermore, in the last sheet P1 of the seat covering paper roll R, there is an end-of-paper detection hole b1. When paper position detection sensor 70 detects this perforation, a paper trouble lamp LED2 is lighted.

Referring to FIG. 12, a power supply circuit including a dry battery 101, which supplies driving power Vcc to the feeding motor M1 and the motor for cutting, etc., M2 and constant-voltage power Vdd to the control unit through a voltage stabilizer 103.

Referring to FIG. 14, circuits connected with input and output terminals of the microcomputer 104 and the circuits are structured as follows.

A position detection circuit 110 of the seat covering paper comprises a paper position detection sensor 70 including a photodiode and a phototransistor. A transistor, connected between the photodiode whose emitter is grounded and the constant-voltage power supply Vdd, functions as a switch. The base of the transistor is connected to an output terminal O1 of the microcomputer 104 through a resistor and the emitter of the photodiode is connected to the input terminal 11 of the microcomputer 104. The photodiode is lighted when the transistor is turned on by a signal from the output terminal 01, whereby the paper position detection sensor 70 can detect the position of the seat covering paper.

A seating detection circuit 111 and movable plate detection circuits 112 and 112*a* are of the same structure as position detection circuit 110.

A number-of-rotations detection circuit 113 of the feeding motor Mll has a rotary encoder 113*a* of an incremental type.

A switch circuit 114 has a feed switch 71. A relay driving circuit has relays X1–X3 that are turned on/off by signals from output terminals O6–O8 of the microcomputer 104 supplied through the respective transistors whose bases are connected to the output terminals and whose emitters are grounded.

A display circuit 116 indicates "paper clogged" and "battery discharged" conditions by lamps LED1 and LED2 respectively.

A battery voltage detection circuit 117 is comprised of a first voltage detecting IC1, a second voltage detecting IC2, and a third voltage detecting IC3. They supply signals indicating battery voltage to specific input terminals I7–I9 of the microcomputer 104, thereby indicating the battery voltage on lamp LED1. There is also a reset circuit RC.

A motor driving circuit 107 (see FIG. 13) includes a first motor driving circuit 105, with contacts X1a and X1b of a relay X1 and a feeding motor M1, and a second motor driving circuit 106 with contacts X2a, X2b and X3*a*, X3*b* of relays X2 and X3 and a cutting motor M2. Both circuits are individually connected in series and inserted between the driving power supply Vcc and ground.

In the toilet seat with the automatic seat covering paper feeder A structured as described above, the essential point of the present invention is that the wet or dry battery supplies electricity to the electrically operated mechanisms such as the feeding mechanism C and cutting mechanism D and the control unit F. The control signals from the control unit F to the mechanisms C and D change in response to changes in the battery voltages. Operation of the toilet seat with the automatic seat covering paper feeder A is divided into initial and normal stages. These stages are shown in the flow charts of FIG. 23–FIG. 26 and the sequential diagrams of FIG. 27.

Figure 23:
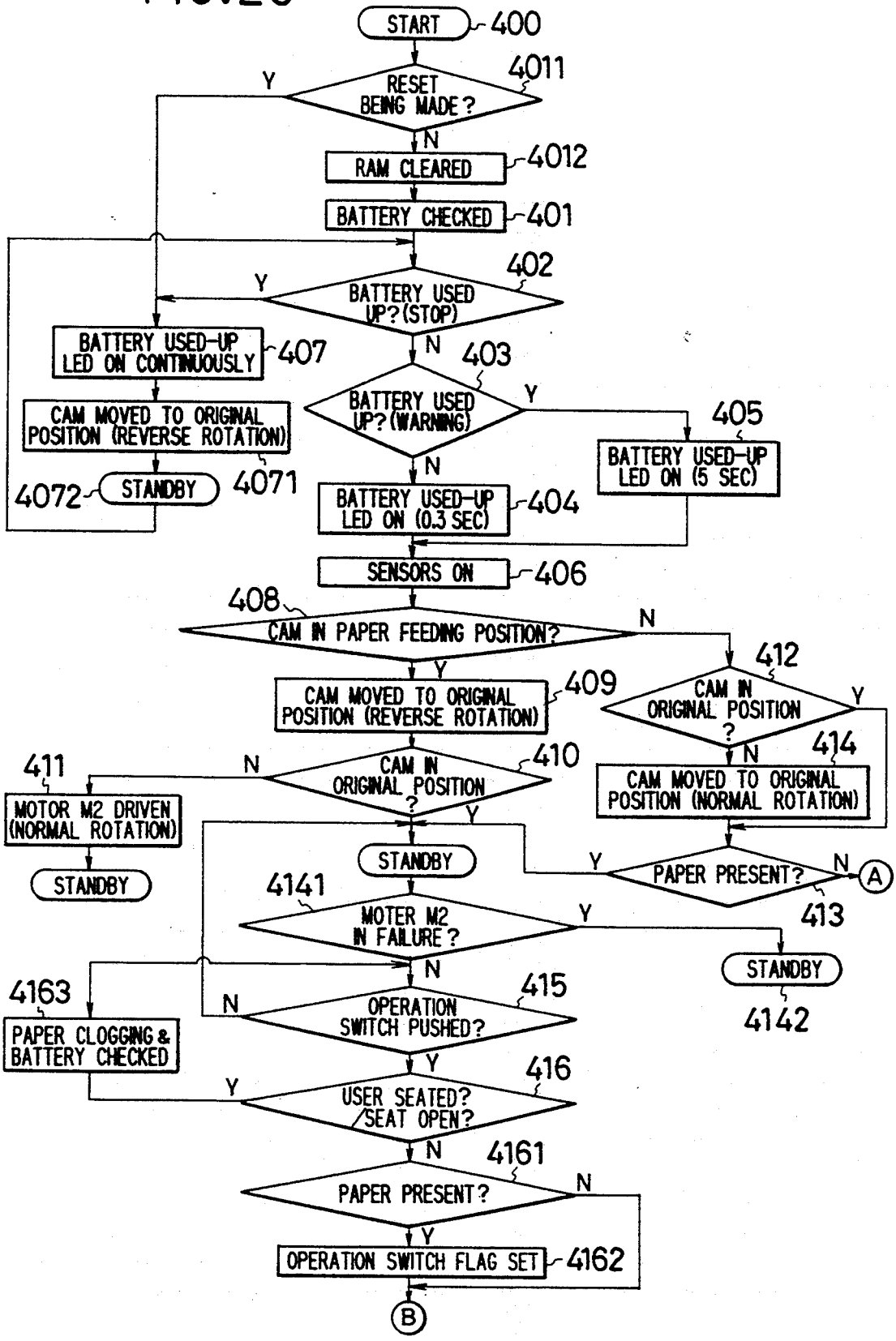
FIG. 23 is a flow chart showing controlled operational sequence of the paper feeding apparatus in of FIG. 4.

Initial-stage Operation (Battery loading and initial setting) (Refer to FIG. 23.)

Inserting a battery into the dry battery case 15*a* starts the program (400). If resetting is not required (4011N), RAM is cleared (4012), and the battery is checked in steps (401)–(403). If the battery charge is normal, the battery discharged indicating lamp LED1 is lighted for 0.3 second in step (404), and the program advances to step (406), in which voltage is supplied to the rotary encoder 113*a*, movable plate position detection sensors 93 and 93*a*, and seating sensor 72. When resetting is required in the step (4011) or when the battery voltage is lower than 4 V in the step (402), the program moves to step (407), in which the battery discharged indicating lamp LED1 is continuously lighted (407) and the cam rotates backward to restore its original position (4071) and the apparatus goes into standby (4072). When the battery voltage is above 4.5 V in the step (403), the battery discharged indicating lamp LED1 is lighted for 5 seconds (405) and the program moves to the step (406).

In the following step (408), it is decided whether or not the movable plate 50 is in paper feeding position (FIG.27(*b*)) according to the outputs from the sensors 113*a*, 93, and 93*a*. When it is in the paper feeding position(408Y), the motor for cutting M2 rotates backward (409), and the cam returns to its original position so that the movable plate 50 is ready for feeding the seat covering paper as shown in FIG. 27(*a*).

At this time, if the movable plate 50 does not return to its original position within 5 seconds, for example, by the rotation of the motor for cutting M2 (410N), the motor M2 rotates forward for 1 second (411), and the apparatus goes into standby (trouble in paper feed). When in the step (408), the movable plate 50 is in its original position. If it is in the original position (412Y), the program advances to step (413). If it is not in the original position (412N), the motor M2 rotates forward to return the movable plate 50 to its original position (414) and the program advances to step (413).

In the step (413), it is decided whether or not paper is present. If the decision is "Y", the program moves to step (4141). If it is "N", the program jumps to A (normal operations) of FIG. 24.

The paper position detection sensor 70 determines whether or not paper is present by illuminating instantaneously. In the step (4141), it is decided whether or not the motor for cutting M2 is operating normally. When it is not operating normally (4141Y), the apparatus goes into standby (4142) (trouble).

When in the step (4141), cutting motor M2 is operating normally (4141N), it is decided in the following step (415) whether or not the feed switch 71 is closed. If it is closed (415Y), it is decided in the following step 416 whether or not the toilet seat is upright or the user is seated. If the decision is "Y" (416Y), paper clogging and battery are checked (4163) and the program returns to the step(415). If the decision is "N" (416N), it is decided whether or not there is paper present (4161). If the decision is "Y" (4161Y), an operation switch flag is set (4162) and the program moves to B of FIG. 24. When the decision is "N" (4161N), the program moves directly to B of FIG. 24.

The operation switch flag stores the result of whether the paper has been fed or not.

In the flow chart of FIG. 23, the rotation of the cam to the paper feeding position means disc cam 44 rotates together with the detection plates 96 and 96*a*, thereby causing the movable plate 50 to assume its horizontal position. The rotation of the cam to the original position means the movable plate 50 returns to the position that closes delivery opening 8*a*. In this state, the disc cam 44 and the detection plates 96 and 96*a* return to their starting positions.

Figure 24:
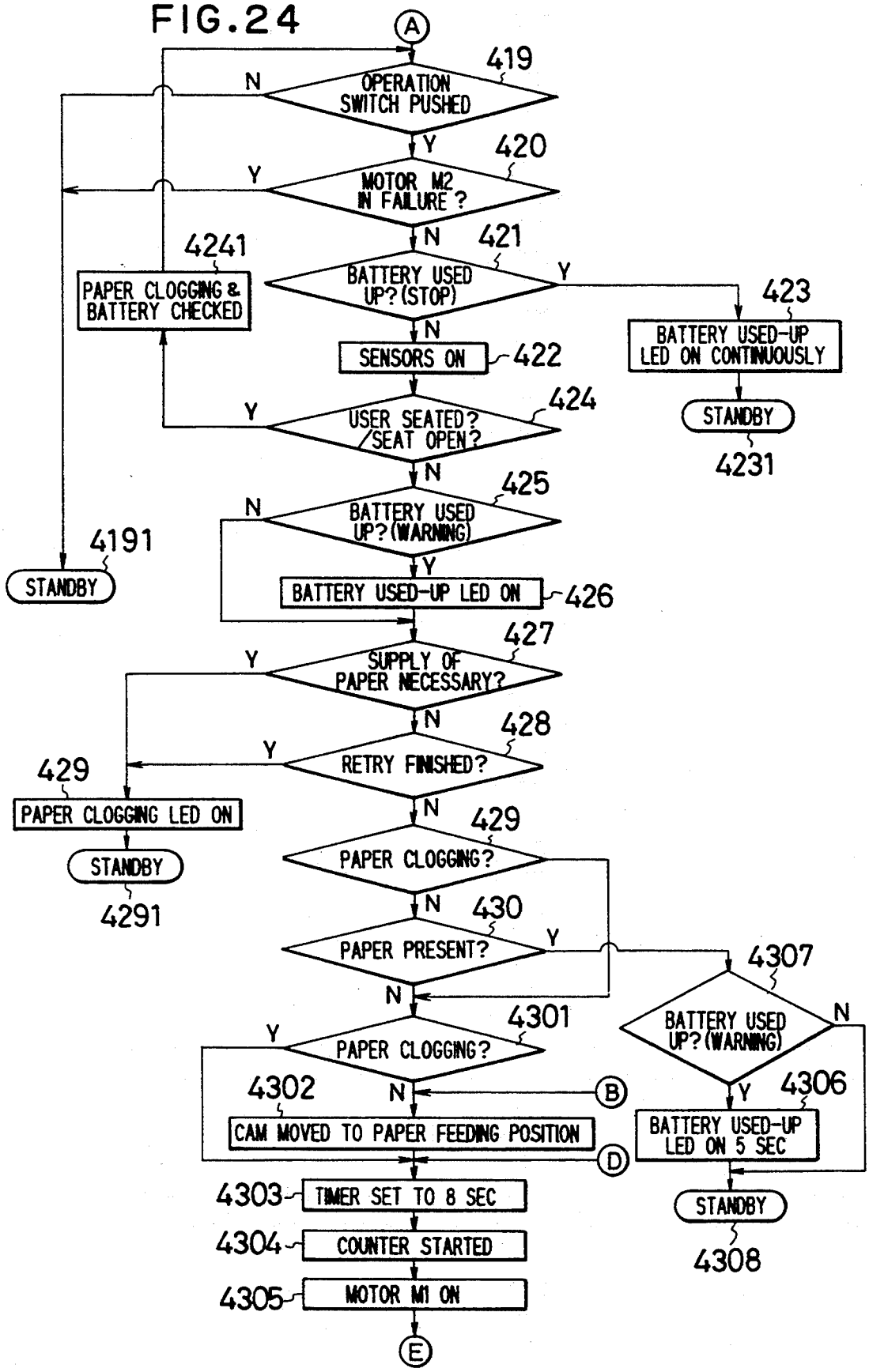
FIG. 24 is a flow chart showing controlled operational sequence of the paper feeding apparatus of FIG. 4.
Figure 25:
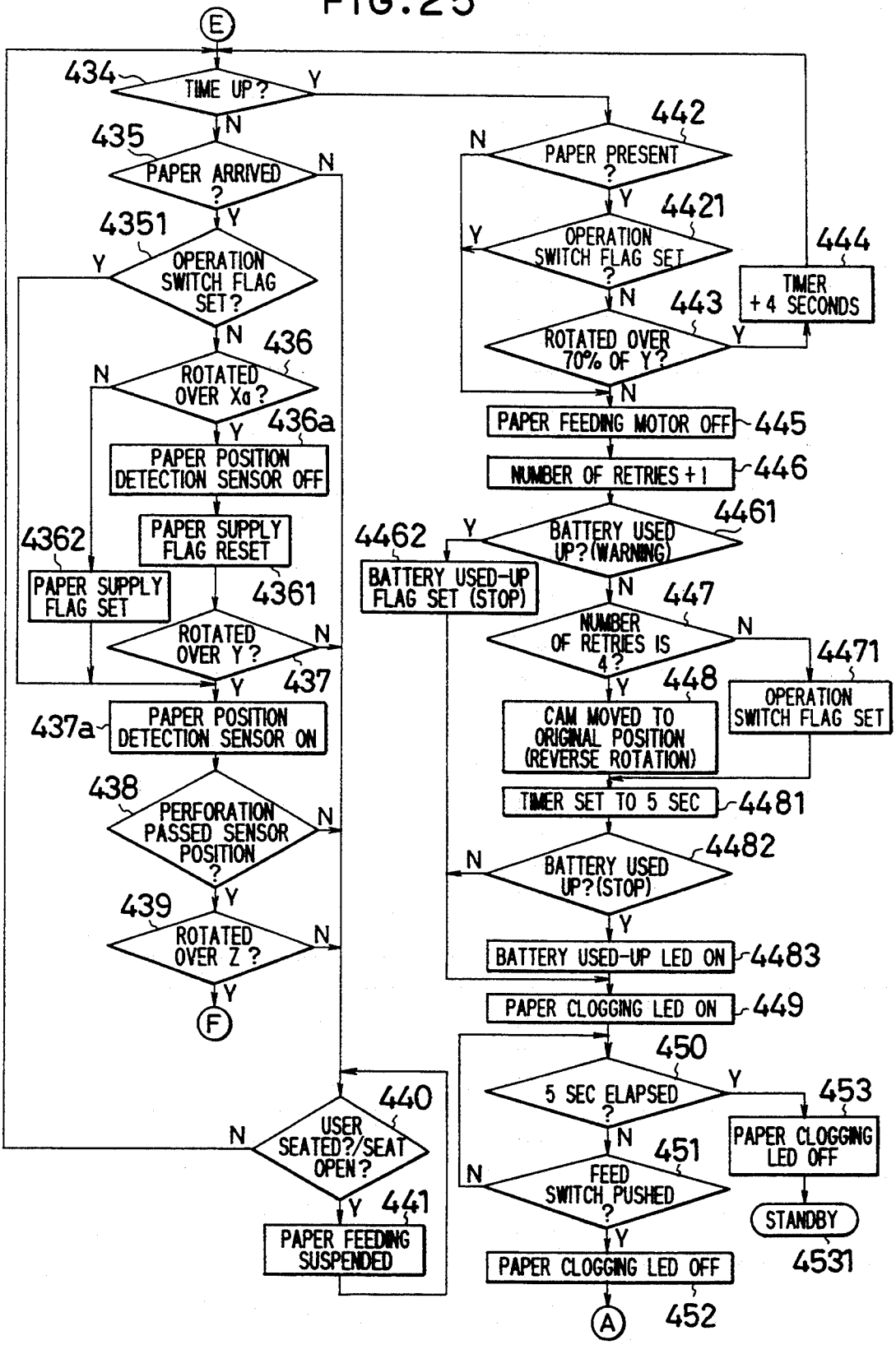
FIG. 25 is a flow chart showing controlled operational sequence of the paper feeding apparatus of FIG. 4.
Figure 26:
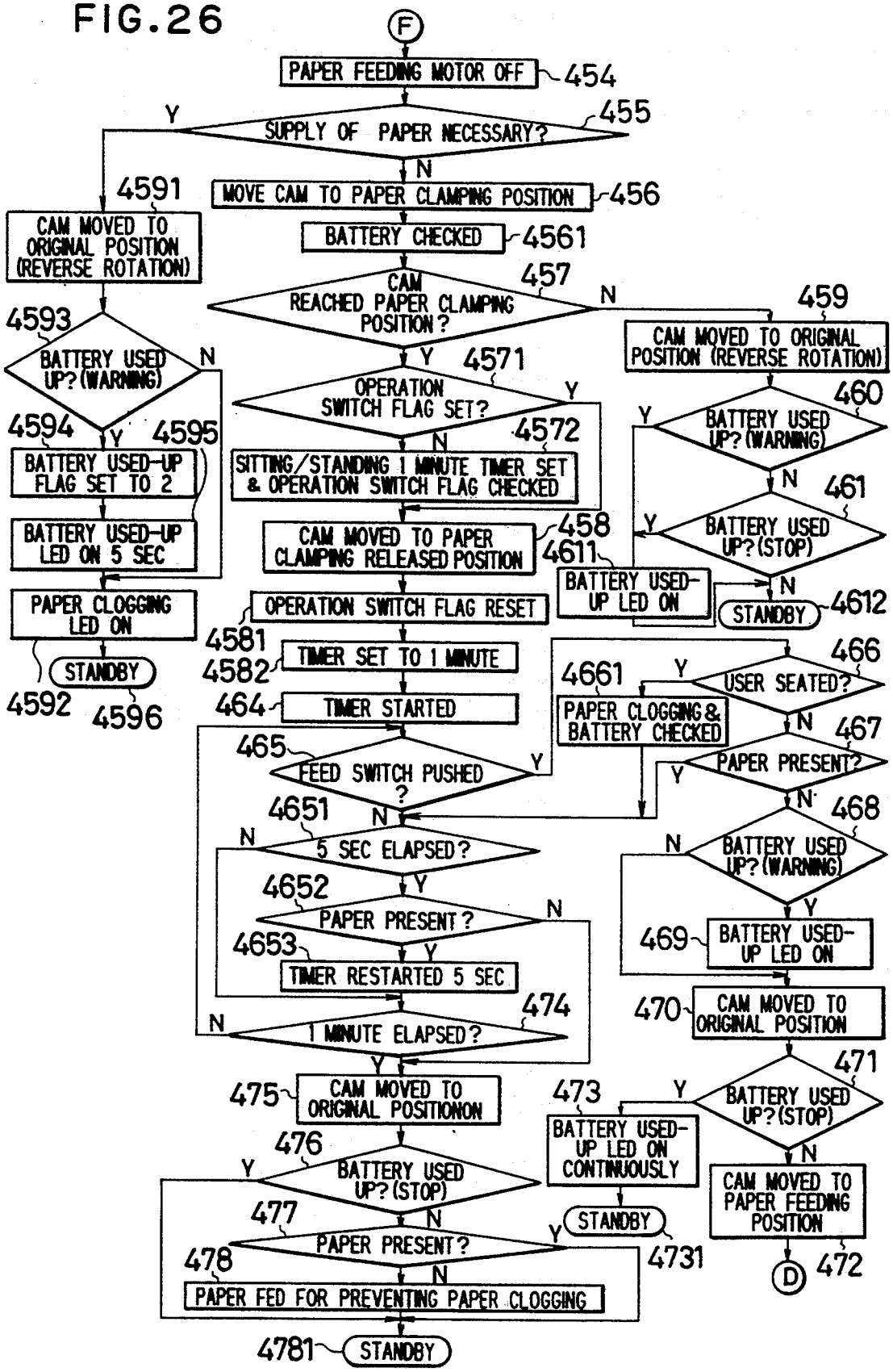
FIG. 26 is a flow chart showing controlled operational sequence of the paper feeding apparatus is FIG. 4.

Normal Operation (Refer to FIG. 24–FIG. 26)

In step (419) from A of FIG. 23, the operation switch 71 is closed. Then the program advances through steps (420)–(421) to step (422), where voltage is applied to the rotary encoder 113*a* and movable plate position detection sensors 93 and 93*a*. Meanwhile, if, in the step (419), the operation switch 71 is not closed (419N), or if, in the step (420), the motor for cutting M2 is not operating (420Y), the apparatus goes into standby (4191) (trouble).

Further, when, in the step (421), the voltage detected by the battery voltage detection circuit 117 is below 4V (421Y), the battery discharged indicating lamp LED1 is continuously lighted (423) and the apparatus goes into standby (4231). The automatic seat covering paper feeder is not driven and paper is not fed as in the case where the motor for cutting M2 is not operating.

Then if, in step (424), the toilet seat is upright or the user is seated (424Y), the program returns to the step (419) after having paper clogging and battery level checked (4241). If the toilet seat is not upright (424N), the program advances to the next step (425), in which, if the battery voltage is below 4.5 V (425Y), the battery discharged indicating lamp LED1 lights for 5 seconds in step (426) to warn that the battery is going to die. The program advances to step (427). If, in the step (425), the battery voltage is higher than 4.5 V(425N), the program directly moves to the step (427).

In the step (427), it is decided whether or not a new supply of paper is required. If the decision is "Y" (427Y), the paper trouble lamp LED2 lights for 5 seconds (429) and the apparatus goes into standby (4291) (the paper is supplied).

When the decision in the step (427) is "N" (427N), it is decided in step (428) whether or not the retry is finished. When it is finished (428Y), the program moves to step (429). When it is unfinished (428N), it is decided in step (429) whether or not the paper is clogging. When the decision is "N" (429N), it is decided in the next step (430) whether or not paper is present. If the decision is "N" (430N), the program advances to the next step (4301). When the decision in the step (430) is "Y" (430Y), the program moves to step (4307), in which, if the battery voltage is below 4.5 V (4307Y), the battery discharged indicating lamp LED1 lights for 5 seconds in step (4306) to warn that the battery is going to die and the apparatus goes into standby (4308). When, in the step (4307), the battery voltage is above 4.5 V (4307N), the program skips the step (4306) and puts the apparatus into standby directly (4308).

In the step (4301), it is decided whether or not the paper is clogging. When the decision is "N" (4301N), the cam is moved to the paper feeding position (4302), the timer in the microcomputer 104 is set to 8 seconds (4303), the counter within the control unit is started (4304), the feeding monitor M1 is turned on (4305), and the program moves to E of FIG. 25. When the decision in the step (4301) is "Y" (4301Y), the program skips the step (4302) and moves directly to the step (4303).

In the step (434) from E of FIG. 25, it is decided whether or not the 8 second period of step (4303) has expired (the step where it has expired (434Y) is described below).

When the decision is "N" (434N), it is decided in step (435), from a signal from paper position detection sensor 70, whether or not the leading end of the paper is at the position of paper position detection sensor 70 (the sensor illuminates when feeding motor M1 starts).

When the paper is there (435Y), it is decided, in the next step (4351), whether or not the operation switch flag is set. When it is not set (4351N), a paper supply flag is reset (4361). In the next step (436), it is decided whether or not the feeding motor M1 has rotated the portion corresponding to the distance Xa shown in FIG. 22. When it has rotated that portion (436Y), the paper position detecting sensor 70 is turned off (436*a*) and the program advances to the next step (437).

In this step, it is decided whether or not the feeding motor M1 has rotated the portion corresponding to the distance Y in FIG. 22. When it has rotated that portion (437Y), the paper position detecting sensor 70 is on (437*a*). It is decided in step (438) from a signal from paper position detection sensor 70 whether or not the position detection hole b has passed paper position detection sensor 70. When it has passed the sensor (438Y), it is decided, in step (439), whether or not the feeding motor M1 has rotated the portion corresponding to the distance Z in FIG. 22. When feeding motor M1, it has rotated that portion (439Y), the program moves to F of FIG. 26.

While the paper is fed during interval Y, the paper position detection sensor 70 is not illuminating. When the paper has been shifted the distance Y in the step (437), the sensor 70 illuminates again and goes out after the detection. The feeding of the paper stops when the paper shifts the distance Z (see FIG. 22).

More specifically, when the paper has shifted the distance Z in the step (439) after the detection of the position detection trough-hole b, the feeding motor M1 stops by D.C. braking. Thus the linear perforations in the paper are accurately placed in cutting position.

When any of the decisions in steps (435), (437), (438), and (439) is "N" (435N), (437N), (438N), (439N), it is determined in step (440) whether or not the toilet seat is upright or the user is seated. When the result is "Y" (440Y), the feeding of the paper is suspended in step (441) and the program returns to the step (440). When the result is "N" (440N), the program returns to the step (434).

When the decision in the step (4351) is "flag is set" (4351Y), the program moves to the step (438). When the decision in the step (436) is "N" (436N), the paper supply flag is set in step (4362), and the program moves to the step (438).

When the 8-second period, set in the step (4303), has expired in the step (434)(434Y), it is decided whether or not the paper is present (the paper position detection sensor 70 illuminates and detects whether or not the paper is present). If the decision is "Y" (442Y), it is determined in step (4421) whether or not the operation flag is set. When the decision is "N" (4421N), the program advances to step (443), in which it is decided whether or not the number of rotations of the feeding motor M1 is more than 70% of the number necessary for feeding the paper the distance Y in FIG. 22 (the number is calculated by the microcomputer 104 from a signal from the rotary encoder 113*a*). If the decision is "Y" (443Y), the setting of the timer is prolonged by 4 seconds in step (444). The program then returns to the step (434, and the paper is again fed (steps 434–439), so that the remainder of the paper is forced out, thereby reducing the frequency of paper clogging.

When in the step (443) the number of rotations of the feeding motor M1 is less than 70% of the required number (443N), the feeding motor M1 is stopped in step (445).

When the decision in the step (442) is "N" (442N) and the decision in the step (4421) is "Y" (4421Y), the program moves to step (445) which stops the feeding motor M1.

In step (446) the counter storing the number of retries is incremented by one. In the following step (4461) it is decided whether or not the battery voltage is below 4.5 V. If the decision is "N" (4461N), it is decided in the following step (447) whether or not the number of retries stored in the counter is 4. When the number is "4" (447Y), the motor for cutting M2 is backward, returning the movable plate 50 to its original position (448). When the battery voltage is below 4.5 V in the step (4461) (4461Y), 2 is set to the battery discharged flag (4462), the movable plate 50 and cam are returned to their original positions (448), and the program advances to the next step (4481). When the decision in the step (447) is "N" (447N), the operation switch flag is set (4471), and the program advances to step (4481).

The operation switch flag is set (4471) to show that the paper was fed the last time as reference for the next retry.

The timer is set to 5 seconds in the step (4481). It is decided, in step (4482), whether or not the battery voltage is below 4 V. When the decision is "below 4 V" (4482Y), the battery discharged indicating lamp LED1 and the paper trouble lamp LED2 are both lighted. When the decision is "N" (4482N), the battery discharged indicating lamp LED 1 is not lighted but the paper trouble lamp LED2 is (449).

When, in step (450), the period of time 5 seconds set in the timer has elapsed (450Y), the paper trouble lamp LED2 is cut off (453) and the apparatus goes into standby (4531). When 5 seconds has not yet elapsed (450N) and the feed switch is not pushed (451N), the program returns to the step (450). However, when the switch is pushed (451Y) the paper trouble lamp LED2 is cut off (452), the program returns to A of FIG. 24, and step (450) is repeated (retry). When the number of retries reaches 4 (step 447), the retry is ended (step 428), the paper trouble lamp LED2 is lighted (429), and the apparatus goes to standby (4291). At this time, the movable plate 50 and cam are returned to their original positions (step 48).

The program shown in FIG. 26 is executed when it is decided in the steps (436–439) (see FIG. 25) that the feeding motor M1 is operating normally. First, the feeding motor M1 is stopped (454). In step (455) it is decided from a signal from paper position detection sensor 70 whether or not a new supply of paper is required (see FIG. 22). When paper is required (455Y) cutting motor M2 is rotated backward so that movable plate 50 returns to its original position (4591). Then the battery voltage is checked (4593). When the battery voltage is below 4.5 V (4593Y), the battery discharged flag is set to 2 (4594), the battery discharged indicating lamp LED1 is lighted for 5 seconds (4595), the paper trouble lamp LED2 is lighted (4592), and the apparatus goes into standby (4596). When, in the step (4593), the battery voltage is above 4.5 V (4593N), the program skips the steps (4594) and (4595) and moves to the step (4592).

When the decision in the step (455) is that new paper is not required (455N), the motor for cutting M2 is started again so that the movable plate 50 is moved to its paper clamping position (456) and the battery voltage is checked (4561). When the movable plate 50 moved to the paper clamping position (457Y), the operation switch flag is checked. When the flag is not set (4571N), a sitting/standing 1-minute timer is set. The operation switch flag is checked again (4572), and the movable plate 50 moved to the paper clamping position (458). Then, the operation switch flag is reset (4581) and the timer is set to 1 minute (4582) and started (464).

Where the feed switch is off in the step (465) (465N), when the set period of 5 seconds has elapsed(4651Y) and the paper position detection sensor 70 detects paper (4652Y), the timer is restarted for 5 seconds (4653). When one minute has elapsed (474Y), the movable plate 50 returns to its original position (475).

When, in step (476), the battery voltage is below 4 V (476Y), the presence of the paper is checked in step (477). If the paper is "not present" (477N), the paper is fed to prevent paper clogging (478) and the apparatus goes into standby (4781). When 5 seconds has not yet elapsed in the step (4651) (4651N), the program jumps to the step (474). If one minute has not yet elapsed in the step (474) (474N), the program returns to the step (465).

When, in the step (457), the movable plate 50 has not yet reached the paper clamping position (457N), the motor for cutting M2 is rotated backward so that the movable plate 50 is returned to its original position (459). The battery voltage is checked in step (460) with 4 V as the threshold value. When the battery voltage is below the threshold value (460Y or 461Y), the battery discharged indicating lamp LED1 is lighted to show the respective threshold values (4611) and the apparatus goes into standby (4612).

When the feed switch is on (465) (465Y) and the user is seated or the toilet seat body 11 is upright (466Y), paper clogging and battery voltage are checked (4661). Then the program moves to step (4661). When the user is not seated and the toilet seat body 11 is not upright (466) (466N), presence or absence of the paper is determined (467). When paper is "present" (467Y), the program moves to step (4651) and when paper is "absent" (467N), the battery voltage is checked in step (468). When the battery voltage is below 4.5 V (468Y), the battery discharged indicating lamp LED1 is lighted (469). When battery voltage is above 4.5 V (468N), the battery discharged indicating lamp LED1 is not lighted, and the movable plate 50 is moved to its original position (470). When, in step (471), the battery voltage is below 4 V (471Y), the battery discharged indicating lamp LED1 is not lighted continuously (473) and the apparatus goes into standby (4731). When battery voltage is above 4 V (471N), the movable plate 50 is moved to the paper feeding position (472) and the program moves to D of FIG. 24.

When the paper feed switch is operated, voltage is supplied to each sensor according to the program. The seating detection sensor 72 continually determines whether the user is sitting on or has left the toilet seat (intermittent voltage for prolonging the life of the battery). When the user has left the toilet seat, the seating detection sensor 72 is turned off, and immediately cutting motor M2 drives movable plate 50 from its paper clamping position to its paper releasing position. The timer starts and intermittently applies voltage to the paper position detection sensor 70 at intervals of 5 seconds for one minute so that presence or absence of the paper is determined. Thereafter, upon closing the feed switch 71, whether or not the user is sitting on the toilet seat, whether or not the paper is present, and whether the battery is discharged are determined.

When the paper is removed (discharged by the flushing water) while the voltage is applied to the paper position detection sensor 70 (within one minute), new paper can be fed. At this time, the movable plate 50 returns to its original position to prepare for feeding the new paper.

But, when the feed switch is not on, the paper position detection sensor 70 puts out its light and the movable plate 50 returns to its original position. At this time, if the paper is already removed, a predetermined length of paper is fed in preparation for feeding the paper next time, and the apparatus goes into standby. However, if the paper remains unremoved, it is interpreted as paper clogging and the apparatus goes into standby without doing anything. If, the user removes the paper, the apparatus goes into standby in preparation for feeding the paper next time.

During standby, the control unit is supplied with a minimum of electricity to save the battery.

In the memory p, at least the following programs are stored to allow the microcomputer 104 to perform its functions.

(1) A program for switching the paper feed mode to the maintenance mode according to whether the user is sitting on the toilet seat or the toilet seat is upright. (steps 416Y, 4163 of FIG. 23).

To save the battery, even when the battery voltage is decreased or the seat covering paper P is used up, abnormal operation indicating LED is lighted for a predetermined minimum time such as 5 seconds. However, with this program, the user can readily determine whether the battery needs to be replaced, since the LED is lighted when the user sits on the toilet seat body 11 or lifts up the toiled seat body 11 in the maintenance mode.

(2) A program for placing the control unit F into standby except when the seat covering paper P is being fed to keep the battery from being discharged too rapidly.

More specifically, according to this program, voltage is supplied from the output port 0 for only a predetermined minimum time (for example, 8 seconds) and not supplied when there is no need of operation and control. Thereby, the dry battery 101 can be kept from being discharged too rapidly (steps 419N, 4191 of FIG. 24).

(3) A program for lighting the paper trouble lamp LED2 in the display portion g1 for a short period of time (for example, 5 seconds) and also preventing motors M1 and M2 of the mechanisms C and D from operating when paper trouble such as clogging or breakage occurs (the apparatus is reset when the trouble is remedied by a maintenance operation). (steps 450~4531 of FIG. 25).

With this program, the waste of battery power from prolonged lighting of the LED as well as the unnecessary operation of several mechanisms at the time of trouble occurrence can be effectively prevented.

(4) A program for setting the timer to the predetermined minimum time period (for example, 8 seconds) when paper feeding is started.(step 4303 of FIG. 24).

With this program, the waste of battery power from prolonged operation of the feeding motor M1 can be prevented.

(5) A program for bringing the control unit F from standby into the paper feed mode (when the toilet seat body is in its normal state) or into the maintenance mode (when the toilet seat body is upright).

(6) A program for signaling display portion g1 when the output voltage of the dry battery 101 has fallen to a first threshold value, for example, 4.5 V, so that the battery discharged indicating lamp LED1 is lighted for a minimum period (for example, 5 seconds) to inform the user of the fact that the dry battery 101 is about to die and urge its exchange (steps 403Y, 495 of FIG. 24).

With this program, if the lowering of the voltage will not affect the normal operation of mechanisms and the control unit, adversely the LED1 is lighted for a short period of time to minimize battery discharge.

(7) A program for signaling display portion g1 when the output voltage of the dry battery 101 has fallen to a second threshold value, for example, 4.0 V, so that the battery discharged indicating lamp LED1 is lighted continuously to inform the user that the dry battery 101 is dead and also stopping the mechanisms from operating after they return to their original positions.

With this program, if the lowering of the voltage affects the operation of mechanisms and the control unit, adversely the LED1 is continuously lighted to indicate a service man must replace the battery as soon as possible.

(8) A program for lighting the battery discharged indicating lamp LED 1 in the display portion g1 for a short period (for example, 0.3 second) when the output voltage of the dry battery, 4.5 V, at the time the dry battery 101 is inserted into the dry battery case 15*a*. (step 404 of FIG. 23).

With this program, the user is informed that the battery voltage is normal.

(9) A program for monitoring the output from the rotary encoder 113*a* to count the number of rotations of the feeding motor M1 and measure the fed length of the seat covering paper P.

The number of rotations of the feeding motor M1 required to shift the seat covering paper P the distances A–B, B–C, C–D, and D–E (see FIG. 22) are each stored in the memory. (steps 436, 437 of FIG. 25).

(10) A program for operating only the paper position detection sensor 70 while the seat covering paper P is traveling the distances A–B and C–D to reduce battery discharge.

(11) A program for operating the feeding motor M1 so that, after a piece of the seat covering paper P is removed, a new piece of the seat covering paper P is fed a predetermined length (for example, 20 mm). (step 478 of FIG. 26).

With this program, the clogging of the paper within the functional casing can be prevented.

(12) A program stopping motors M1 and M2 of the mechanisms C and D from operating when the paper position detection sensor 70 detects the last piece P1 of the seat covering paper. (steps 455Y, 4591~4596 of FIG. 26).

With this program, the cutting of the last seat covering paper can be prevented so that the discharge battery from the operation of the cutting motor M2 can be minimized.

(13) A program for moving the movable plate 50 to its original position by motor for cutting M2 when the battery has been exchanged. (steps 409, 414 of FIG. 23).

With this program, the power source and all operating parts are reset so that the reliable operation of the apparatus is assured.

(14) A program for causing the paper position detection sensor 70 to illuminate for a short period of time to decide presence or absence of the paper when the feed switch is closed. (step 4161 of FIG. 23, step 430 of FIG.24).

With this program, the time for supplying electricity to the paper position detection sensor 70 can be minimized so that the battery discharge from the operation of the sensor 70 can be minimized.

(15) A program for operating the motor for cutting M2 to cause the movable plate 50 to return to its original position, after four retries of the feed switch 71, when paper clogging has occurred. (steps 447, 448 of FIG. 25).

With this program, the unnecessary operation of the cutting motor M2 in connection with the operation of the feed switch 71 can be prevented so that the battery discharge from the operation of the cutting motor M2 can be minimized.

(16) A program for starting the DC motor for cutting M2 to move the movable plate 50 to its paper clamping position after the feeding motor M1 has stopped and, when the movable plate 50 does not reach the paper clamping position within 5 seconds, returning the movable plate 50 to its original position. (steps 457, 459, 4612 of FIG. 26).

With this program, the unnecessary operation of the feed motor M1 can be prevented so that battery discharge from the operation of the feeding motor M1 can be minimized.

(17) A program for supplying power to the seating sensor 72 at intervals of 0.5 second after the feed switch 71 is operated until the user sits on the toilet seat (electricity-saving effect). (steps 419Y~of FIG. 24, of FIG. 26).

With this program, the total time for supplying electricity to the seating sensor 72 can be minimized so that the battery discharge from the operation of the sensor 72 can be minimized.

(18) A program for supplying power to the paper position detection sensor 70 to decide whether the paper is present or absent at intervals of seconds for one minute after paper clamping has been released (electricity-saving effect). (steps 464~474 of FIG. 26)]

With this program, the time for supplying electricity to the paper position detection sensor 70 can be minimized so that the battery discharge from the operation of the sensor 70 can be minimized.

(19) A program, when the paper has not been fed a predetermined length even when the number of rotations of the feeding DC motor M1 has exceeded 70% of the set value for driving the feeding DC motor M1 for a suitable length of time (for example, 4 seconds) additional to the predetermined set time (for example, 8 seconds). (steps 443Y, 444 of FIG. 25).

With this program, even when the feeding is slowed the seat covering paper P can be reliably and accurately fed onto the toilet seat body 11.

(20) A program for automatically stopping the operation of the microcomputer when the battery voltage has fallen below a third threshold voltage, for example, 3.5 V (all steps of FIG. 23 to FIG. 26).

With this program, the erroneous operation of the mechanisms and the control unit F can be reliably prevented.

As shown in the above described programs (6), (7), (8), and (20) and corresponding FIG. 23–FIG. 26, the voltage of the battery is determined by the voltage detection portion in the control unit F, and, when the battery voltage falls to a first threshold value, for example, 4.5 V, the battery discharged indicating LED1 in the display portion g1 is lighted for a short period of time to warn that the battery is going to die, and, when the battery voltage falls to a second threshold value, for example, 4.0 V, the battery discharged indicating lamp LED1 is continuously lighted to inform the user that the battery is dead and urge its exchange. At the same time, the motors M1 and M2 remain stopped after returning the feeding mechanism C and cutting mechanism D to their original positions. Accordingly, trouble from incomplete operations of these mechanisms can be prevented. Further, when the battery voltage falls below a third value, for example, 3.5 V, the control sequence of the microcomputer of the control unit F is stopped while the power supply to the microcomputer 104 continues. Accordingly, trouble such as the running away of the microcomputer 104 from unstable operation of the control unit F can be prevented.

It can also be arranged that a minimum of mechanisms are operated while other mechanisms are not. For example, as the voltage falls, only the feeding mechanism is allowed to operate, while mechanisms consuming amounts of current (such as the cutting mechanism) are not allowed to operate (skipping operation of the cutting mechanism), the order of operation of various mechanisms is changed (mechanisms that consume less current run first, and operating and controlling periods of mechanisms and sensors are changed (shortened).

The supplied voltage detection means is not limited to detecting the voltage supplied to the control unit. Various changes are possible, such as determining the voltages supplied to each of the mechanisms or determining the voltage of the power supply to the control unit F and various mechanisms.

Modification of Operation Program

This modification of the operation program substantially follows the above-mentioned programs (17) (18) and is characterized by the periodic supply of electricity to paper position detecting means to detect the presence of the seat covering paper on the toilet seat body 11.

Figure 28:
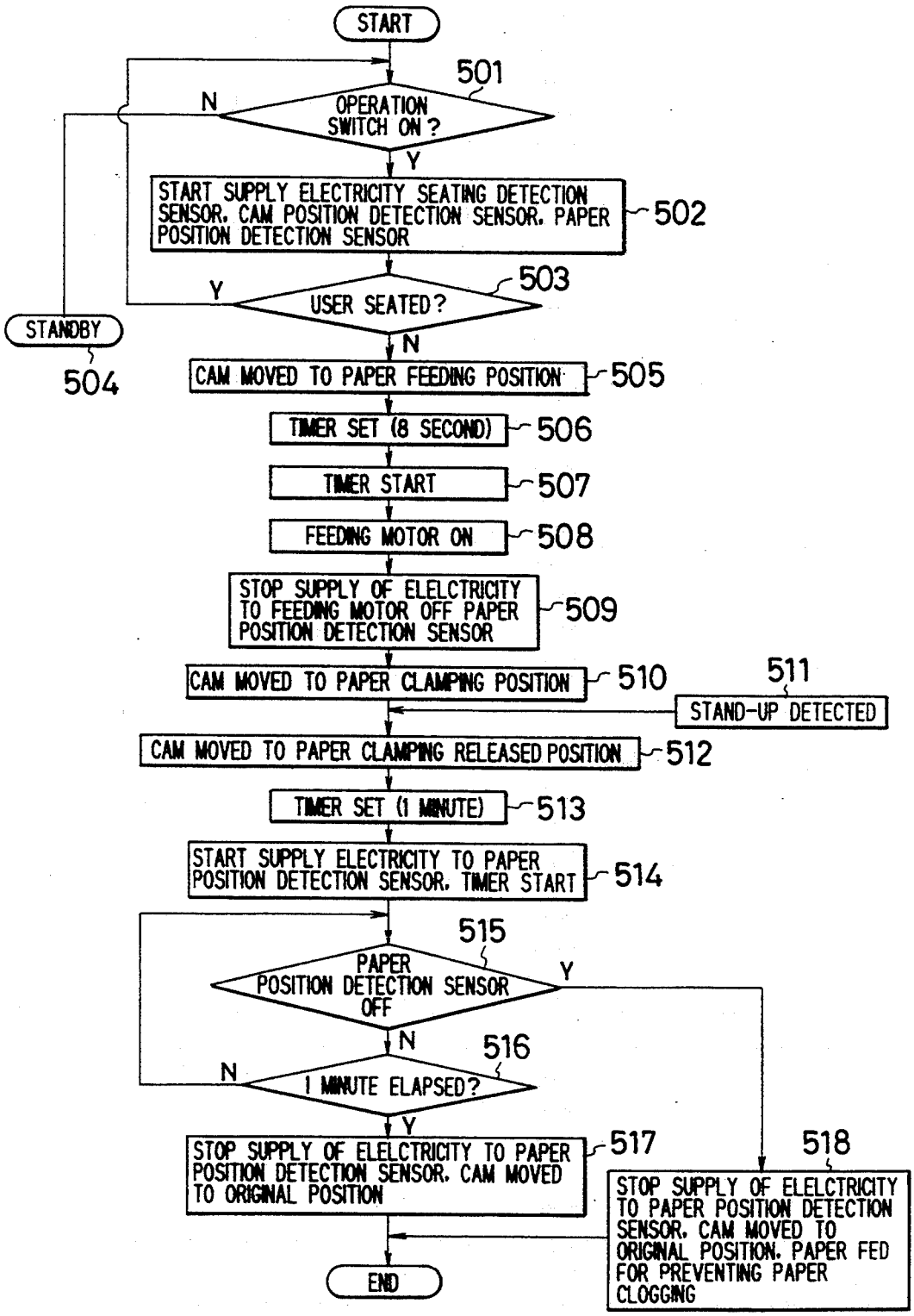
FIG. 28 is a flow chart showing an additional controlled operational sequence of the paper feeding apparatus of FIG. 4.

Referring to FIG. 28, when the feed switch 71 is turned on, the seat covering paper P is fed onto the toilet seat body 11. Subsequently the movable plate 50 is rotated to clamp the seat covering paper P between presser pieces 56 and 57. Then, when the user sits on the toilet seat body 11, the seating detection means (sensor) 72 is turned on. When the user stands up from the toilet seat 11, the seating detection means 72 is turned off. When the seating detection means 72 is turned off, the movable plate 50 is shifted from a paper clamping position to a paper released position so that, along with the drainage of the waste water in the toilet bowl, the used seat covering paper P is discharged from the toilet bowl and the program advances to the next step. In this series of operations, when the movable plate 50 is shifted to the paper clamping released position to release the clamping of the seat covering paper P after detecting that the user has stood up, the electricity is intermittently supplied for a predetermined period to detect whether the seat covering paper P has been removed from the toilet seat 11.

For example, after release of the paper clamping, electricity is intermittently supplied to the sensor 70 twelve times within 1 minute at intervals of 5 seconds to check the presence of the seat covering paper P.

Referring to FIG. 27 and FIG. 28, when the feed switch 71 is turned on (501), the movable plate 50 is moved from the original or stand-by position to a paper feeding position (FIG. 27 (b)). In step (503Y), when the toilet seat is lifted or the user sits on the toilet seat, the microcomputer 104 is switched to the maintenance mode (504). When the detected voltage of the battery is than 4 V, the battery discharged indication lamp LED1 is continuously lit to indicate that the battery cannot supply power to the seat paper P.

When the initial battery mounting operation is completed, the feed switch 71 is turned on to feed seat paper P.

That is when the feed switch 71 is turned on (501), electricity is supplied to the rotary encoder 113*a*, the movable plate position detection sensors 93, 93*a*, and sit-on detecting sensor 72 (502).

When the toilet seat is lifted or the user sits on the toilet seat, the microcomputer 104 is switched to the maintenance mode (504).

When the microcomputer 104 decides that the toilet seat is not lifted and the user is not sitting on the toilet seat (503N), the movable plate 50 is moved to a horizontal position to open the seat paper delivery opening 8*a* (505) (FIG. 27(*b*)).

After the movement of the movable plate 50, when a timer within the microcomputer 104 is set (8 seconds) (506), the timer starts (507) and the DC feeding motor M1 starts feeding the seat paper (508).

The paper position detecting sensor 70 and the rotary encoder 13*a* convey the breaking perforations formed on the seat paper P to a paper cutting position (509).

When the DC feeding motor M1 stops the DC cutting motor M2 is actuated and the movable plate 50 is shifted to the clamping position, whereby the seat paper P can be simultaneously clamped and cut (510) (FIG. 27(*e*)–(*f*).

Meanwhile, electricity is supplied every 0.5 seconds to the sit-on detected sensor and operation switch 71 is turned on (503), (511), (512), and so on. Sensor 72 detects that the user is seated on the toilet seat and generates an ON signal. Thereafter, sensor 72 detects that the user has stood up and generates an OFF signal (512Y). DC cutting motor M2 moves the movable plate 50 from the paper clamping position to the paper released position (512)(FIG. 27(*g*)).

The timer is then set to supply electricity intermittently to the paper position detecting sensor 70 for 1 minute and seat paper P can be disposed of when the toilet is flushed (513)(514).

In these operations, when the movable plate 50 is at the paper released position, the paper delivery opening 8*a* is open so that the foul or contaminated water may enter the casing 15.

To prevent entry of contaminated water, paper feeding opening 8*a* must be closed off by the contaminated water preventing barrier BP when the apparatus is not used.

After seat paper P is discharged with the flushing water while electricity is intermittently supplied to the paper position detecting sensor 70 for a minute (515Y), the supply of electricity to the paper position detecting sensor 70 is stopped and the movable plate 50 returns to the original position. Subsequently, the feeding motor M1 is actuated to feed the seat paper P a predetermined distance, for example, 20 mm, to prevent the clogging or hamming of the seat paper P in the apparatus (518).

When the 1 minute set by the timer is over (516Y), the supply of electricity to the paper position detecting sensor 70 is stopped and the movable plate 50 is forced to return to the original position (517)(FIG. 27(*h*)).

In this normal operation cycle, after seat paper P is fed the user sits on and stands up from the toilet sear. The paper is removed from the toilet seat in preparation for the next feeding of the seat paper P. To control this cycle, the memory p of the microcomputer 104 is provided with a program.

The program prescribes that, after releasing of the clamping of the seat paper P, the electricity is intermittently supplied at an interval of 5 seconds for 1 minute to detect the presence of the seat paper P as shown in FIG. 28.

What is claimed is:

1. An apparatus for automatically feeding seat covering paper for a toilet seat comprising:

a) an electrically driven seat covering paper feeding mechanism for feeding said seat covering paper from a seat covering paper roll stored in a seat covering paper roll storage portion onto a toilet seat body through a seat covering paper feed path;

said seat covering paper being divided into sections;

said seat covering paper feeding mechanism including a seat covering paper feeding motor;

b) an electrically driven seat covering paper cutting mechanism including means for cutting said seat covering paper fed onto the surface of said toilet seat body at a rear edge portion of a one of said sections of said seat covering paper;

c) timer means for measuring an operating time of said seat covering paper feeding motor;

d) revolution detecting means for detecting a total number of revolutions of said seat covering paper feeding motor within a predetermined time;

seat covering paper position detecting means for detecting a through hole at a completion position of said seat covering paper effective to accurately detect the completion of a feeding of said seat covering paper onto said toilet seat body;

e) a control unit for operating said seat covering paper feeding mechanism and said seat covering paper cutting mechanism by predetermined control signals sequentially output therefrom to thereby control feeding said seat covering paper to be fed on said toilet seat body and cutting of said seat covering paper;

means, responsive to a completion of a first predetermined total number of revolutions of said seat covering paper feeding motor within said predetermined time, for stopping said seat covering paper feeding motor;

means, responsive to a completion of a second predetermined total number of revolutions of said seat covering paper feeding motor at a completion of said predetermined time, for permitting continued operation of said seat covering paper feeding motor for an additional period of time following said predetermined time;

said second predetermined total number of revolutions being less than said first predetermined number of revolutions;

means, responsive to a completion of less than said second predetermined number of revolutions within said predetermined time, for terminating operation of said seat covering paper feeding motor; and (f) battery means for supplying electricity to said seat covering paper feeding mechanism, said seat covering paper cutting mechanism, said control unit, said timer means, said revolution detecting means and said paper detecting means.

2. The apparatus for automatically feeding seat covering paper for a toilet seat according to claim 1, wherein said seat covering paper cutting mechanism includes means for clamping said rear edge portion and means for covering and uncovering a seat covering paper delivery opening located along said seat covering paper feed path.

3. The apparatus for automatically feeding seat covering paper for a toilet seat according to claim 1, wherein:

said control unit includes a supply voltage detection means which detects a supply voltage to said seat covering paper feeding mechanism, said seat covering paper cutting mechanism, and said control unit;

said control unit further includes means for determining which said control signals are to be supplied to said seat covering paper feeding mechanism and said seat covering paper cutting mechanism in accordance with results of detection by said supply voltage detection means.

4. The apparatus for automatically feeding seat covering paper for a toilet seat according to claim 1, said control unit further including:

supply voltage detection means which detects a supply voltage to said seat covering paper feeding mechanism, said seat covering paper cutting mechanism, and said control unit; and voltage indication means for indicating said detected supply voltage.

5. The apparatus for automatically feeding seat covering paper for a toilet seat according to claim 1, wherein said battery means supplies electricity to said seat covering paper position detecting means when said control unit sends a predetermined control signal based on reception of a preset detection signal from said revolution detecting means.

6. The apparatus for automatically feeding seat covering paper for a toilet seat according to claim 1, wherein:

said apparatus is further provided with seating detection means for detecting when a user sits on and stands from said toilet seat; and said battery means intermittently applies electricity, at predetermined intervals, to said seating detection means.

7. The apparatus for automatically feeding seat covering paper for a toilet seat according to claim 1, wherein:

said battery means intermittently applies electricity to said paper position detection means at predetermined intervals.

8. The apparatus for automatically feeding seat covering paper for a toilet seat according to claim 1, wherein said control unit includes means for controlling said seat covering paper cutting mechanism from a normal position to a cutting position and back such that when said seat covering paper cutting mechanism is unable to cut said seat covering paper within a predetermined time, said cutting mechanism is returned to said normal position.

9. The apparatus for automatically feeding seat covering paper for a toilet seat according to claim 1, wherein said revolution detecting means is a rotary encoder.

10. The apparatus for automatically feeding seat covering paper for a toilet seat according to claim 1, wherein said seat covering paper feeding mechanism includes:

a feeding roller;

an outer surface of said feeding roller;

a rate of rotation of said feeding roller;

means for engaging said seat covering paper against said outer surface of said feeding roller, whereby said seat covering paper is fed at a rate proportional to said rate of rotation; and a power transmission mechanism including a worm gear and a worm wheel operably interposed between said seat covering paper feeding motor and said feeding roller.

11. The apparatus for automatically feeding seat covering paper for a toilet seat according to claim 10, wherein:

said control unit includes means for for shorting power terminals of said feeding motor, whereby, when said feeding motor is to be stopped, a braking force is generated in said motor.

12. The apparatus for automatically feeding seat covering paper for a toilet seat according to claim 1, wherein:

said battery means comprises a battery case and a cartridge replaceably inserted into said battery case; and said cartridge is adapted to receive at least one dry battery.

13. The apparatus for automatically feeding seat covering paper for a toilet seat according to claim 12, wherein:

said at least one dry battery is connected to a contact formed on a side of said cartridge only when said at least one dry battery is inserted into said cartridge in a predetermined direction, and said cartridge is incorporated into said dry battery case only when said cartridge is turned in a predetermined direction; and a cartridge contact on said cartridge and a battery case contact on said battery case, mounted in a face-face relationship, and are situated to slide against each other when said cartridge is incorporated into said battery case.

14. Apparatus as in claim 1, wherein said first predetermined total number of revolutions is a substantial fraction of a total number of revolutions required to feed sufficient seat covering paper to cover said toilet seat body.

* * * * *

UNITED STATES PATENT AND TRADEMARK OFFICE

CERTIFICATE OF CORRECTION

PATENT NO. : 5,438,711

DATED : August 8, 1995

INVENTOR(S) : Mitsuhiro HIGUCHI, Shigeru MIZOGUCHI, Naoji YAMASHITA, Takayoshi ADACHI It is certified that error appears in the above-indentified patent and that said Letters Patent is hereby corrected as shown below:

Cover Page, Item [73], please change

"Aicho Electric Co., Ltd., Aicho," to --Aichi Electric Co., Ltd., Aichi--

Signed and Sealed this

First Day of October, 1996

*Attest:*

*Attesting Officer*

Bruce Lehman

BRUCE LEHMAN

*Commissioner of Patents and Trademarks*